US012359563B2

(12) United States Patent
ElGamal

(10) Patent No.: US 12,359,563 B2
(45) **Date of Patent: *Jul. 15, 2025**

(54) LOGGING AND ANALYSIS MODULE FOR DRILL CUTTINGS, AND METHOD OF ANALYZING DRILLING FLUID

(71) Applicant: Ahmed M. H. ElGamal, Stanford, CA (US)

(72) Inventor: Ahmed M. H. ElGamal, Palo Alto, CA (US)

( * ) Notice: Subject to any disclaimer, the term of this patent is extended or adjusted under 35 U.S.C. 154(b) by 122 days.

This patent is subject to a terminal disclaimer.

(21) Appl. No.: 17/931,805

(22) Filed: Sep. 13, 2022

(65) Prior Publication Data

US 2023/0054107 A1 Feb. 23, 2023

Related U.S. Application Data

(62) Division of application No. 16/728,169, filed on Dec. 27, 2019, now Pat. No. 11,492,901.

(Continued)

(51) Int. Cl.
*E21B 49/00* (2006.01)
*E21B 21/01* (2006.01)

(Continued)

(52) U.S. Cl.
CPC ..... *E21B 49/005* (2013.01); *E21B 21/01* (2013.01); *E21B 49/084* (2013.01);

(Continued)

(58) Field of Classification Search
CPC .... E21B 21/01; E21B 49/086; E21B 49/0875; E21B 49/005
See application file for complete search history.

(56) References Cited

U.S. PATENT DOCUMENTS 2,206,922 A * 7/1940 Smith ..... E21B 47/04 175/206
4,582,992 A * 4/1986 Atwell ..... G01N 23/222 250/359.1

(Continued)

OTHER PUBLICATIONS

Web document definition of a "Shale Shaker" Schlumberger Energy Glossary (Year: 2024).*

(Continued)

*Primary Examiner* — John Fitzgerald
(74) *Attorney, Agent, or Firm* — Peter L. Brewer; Thrive IP

(57) ABSTRACT

A shale shaker system. The system includes a fluid transport pipe configured to receive a stream of drill cuttings and fluid returns from a wellbore during a drilling operation; an analysis module configured to receive at least a portion of the stream of drill cuttings and fluid returns at an inlet; a cuttings chute configured to receive at least a portion of the stream of drill cuttings and fluid returns from an outlet of the container, and deliver them to a screen box; and one or more screens for filtering drill cuttings from the fluid returns. The analysis module comprises logging sensors configured to operate while drill cuttings are moving through the system. The logging sensors communicate with a processor to determine characteristics of the drill cuttings in real time. A method for analyzing drill cuttings at a well site is also provided.

11 Claims, 13 Drawing Sheets

Related U.S. Application Data

(60) Provisional application No. 62/935,797, filed on Nov. 15, 2019, provisional application No. 62/815,081, filed on Mar. 7, 2019.

(51) Int. Cl.
*E21B 49/08* (2006.01)
*E21B 47/04* (2012.01)

(52) U.S. Cl.
CPC ..... *E21B 49/086* (2013.01); *E21B 47/04* (2013.01); *E21B 49/0875* (2020.05)

(56) References Cited

U.S. PATENT DOCUMENTS 4,904,603 A * 2/1990 Jones ..... E21B 49/005 436/27
5,165,275 A * 11/1992 Donovan ..... E21B 49/005 250/254
7,278,540 B2 * 10/2007 Stone ..... B01D 33/37 209/404
7,331,469 B2 * 2/2008 Padalino ..... B01D 33/807 209/412
7,571,817 B2 * 8/2009 Scott ..... B07B 13/18 209/412
8,746,459 B2 * 6/2014 Scott ..... B01D 33/0376 209/555
9,506,337 B2 * 11/2016 Smith ..... E21B 21/066
9,651,468 B2 * 5/2017 Rowe ..... G01N 33/24
10,633,941 B2 * 4/2020 Teodorescu ..... B01D 33/0376
10,655,464 B2 * 5/2020 Kasprzykowski .... E21B 49/005
10,796,424 B2 * 10/2020 Parmeshwar ..... E21B 49/003
10,822,895 B2 * 11/2020 Torjussen ..... E21B 21/08
10,927,671 B1 * 2/2021 Tonner ..... E21B 21/01
11,401,806 B2 * 8/2022 Rowe ..... G01F 22/00
11,492,901 B2 * 11/2022 ElGamal ..... E21B 21/01
11,753,925 B2 * 9/2023 Hardeman ..... E21B 47/003 175/24
11,788,408 B2 * 10/2023 Ismailova ..... G01N 33/241 73/152.11
11,906,395 B2 * 2/2024 Shekhar ..... G01L 1/22
11,946,367 B2 * 4/2024 Mezghani ..... E21B 47/0025
12,123,268 B2 * 10/2024 Ross ..... E21B 21/065
2005/0242003 A1 * 11/2005 Scott ..... B01D 33/0315 210/388
2006/0243643 A1 * 11/2006 Scott ..... B07B 1/4663 209/309
2008/0156532 A1 * 7/2008 Zamfes ..... G01V 5/12 175/40
2008/0192987 A1 * 8/2008 Helgason ..... G01N 33/24 382/109
2008/0202811 A1 * 8/2008 Zamfes ..... E21B 49/005 175/46
2009/0260430 A1 * 10/2009 Zamfes ..... E21B 21/08 73/152.21
2013/0073207 A1 * 3/2013 Ganz ..... G01N 33/24 73/152.05
2013/0319104 A1 * 12/2013 Schexnaider ..... G01N 1/2294 73/152.42
2014/0020954 A1 * 1/2014 Pelletier ..... G01V 99/00 356/402
2014/0046628 A1 * 2/2014 Ligneul ..... E21B 49/005 702/158
2014/0214325 A1 * 7/2014 Wessling ..... E21B 47/06 702/11
2014/0333754 A1 * 11/2014 Graves ..... E21B 47/002 348/85
2015/0013448 A1 * 1/2015 Smith ..... E21B 49/005 73/152.46
2015/0020588 A1 * 1/2015 Larson ..... G01N 15/0205 73/32 R
2016/0370274 A1 * 12/2016 Rowe ..... G01N 15/1433
2017/0089153 A1 * 3/2017 Teodorescu ..... E21B 43/10
2017/0161885 A1 * 6/2017 Parmeshwar ..... G06T 7/0004
2019/0212282 A1 * 7/2019 Reiderman ..... E21B 49/08
2019/0309589 A1 * 10/2019 Torjussen ..... G01F 1/72
2019/0390524 A1 * 12/2019 Bentamy ..... G01N 33/0011
2020/0018161 A1 * 1/2020 Stepanov ..... E21B 21/01
2020/0157929 A1 * 5/2020 Torrione ..... G05B 15/02
2020/0363289 A1 * 11/2020 Shekhar ..... E21B 21/065
2021/0019875 A1 * 1/2021 Parmeshwar ..... G01N 21/88
2021/0131203 A1 * 5/2021 Bingham ..... B01D 33/41
2021/0404330 A1 * 12/2021 Torlov ..... G06V 10/751
2022/0136344 A1 * 5/2022 Mora ..... H04N 7/183 175/48
2022/0268153 A1 * 8/2022 Mezghani ..... E21B 47/0025

OTHER PUBLICATIONS

Zamfes et al. Analytical Formation Sampling During Drilling Using OPAL—on Surface Petrophysical Analytical Logging, Search and Discovery Article #41854, 21 pages (Year: 2016).*

* cited by examiner

LOGGING AND ANALYSIS MODULE FOR DRILL CUTTINGS, AND METHOD OF ANALYZING DRILLING FLUID

CROSS REFERENCE TO RELATED APPLICATIONS

This application claims the benefit of U.S. Ser. No. 62/815,081 entitled "Optimized Shale Shaker System and Method of Use." That application was filed on Mar. 7, 2019.

This application further claims the benefit of U.S. Ser. No. 62/935,797 entitled "Shale Shaker System Having Sensors, and Method of Use." That application was filed Nov. 15, 2019.

Each of these provisional applications is incorporated herein in its entirety by reference.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

FIELD OF THE INVENTION

The present disclosure relates to the field of petroleum drilling systems. More specifically, the invention relates to a shaker system used for collecting and analyzing drill cuttings at a drill site. The invention also relates to a shale shaker system having an analysis module for analyzing drill cuttings during a well drilling operation, and to methods for sampling and analyzing drill cuttings in real time.

Technology in the Field of the Invention

In the drilling of an oil and gas well, a near-vertical wellbore is formed through the earth using a drill bit urged downwardly at a lower end of a drill string. The drill bit is rotated in order to form the wellbore, while drilling fluid is pumped through the drill string and back up to the surface on the back side of the pipe. The drilling fluid serves to cool the bit and flush drill cuttings during rotation and cutting.

FIG. 1 is a side, cross-sectional view of an illustrative well site 100. The well site 100 includes a derrick 120 at an earth surface 101. A wellbore 150 extending from the earth surface 101 into an earth subsurface 155 is being formed through a drilling process. Specifically, the wellbore 150 is being formed using the derrick 120, a drill string 160 below the derrick 120, and a bottom hole assembly 170 at a lower end of the drill string 160.

Referring first to the derrick 120, the derrick 120 includes a frame structure 121 that extends up from the earth surface 101 and which supports drilling equipment. The derrick 120 also includes a traveling block 122, a crown block 123 and a swivel 124. A so-called kelly 125 is attached to the swivel 124. The kelly 125 has a longitudinally extending bore (not shown) in fluid communication with a kelly hose 126. The kelly hose 126, also known as a mud hose, is a flexible, steel-reinforced, high-pressure hose that delivers drilling fluid through the bore of the kelly 125 and down into the drill string 160.

The kelly 125 includes a drive section 127. The drive section 127 is non-circular in cross-section and conforms to an opening 128 longitudinally extending through a kelly drive bushing 129. The kelly drive bushing 129 is part of a rotary table. The rotary table is a mechanically driven device that provides clockwise (as viewed from above) rotational force to the kelly 125 and connected drill string 160 to facilitate the process of drilling a borehole 105. Both linear and rotational movement may thus be imparted from the kelly 125 to the drill string 160 while drilling fluid is pumped through the mud hose 126.

A platform 102 is provided for the derrick 120. The platform 102 extends above the earth surface 101. The platform 102 generally supports rig hands along with various components of drilling equipment such as pumps, motors, gauges, a dope bucket, pipe lifting equipment and control equipment. The platform 102 also supports the rotary table.

It is understood that the platform 102 shown in FIG. 1 is somewhat schematic. It is also understood that the platform 102 is merely illustrative and that many designs for drilling rigs, both for onshore and for offshore operations, exist. The inventions provided herein are not limited by the configuration and features of the drilling rig 120 unless expressly stated in the claims.

Placed below the platform 102 and the kelly drive section 127 but above the earth surface 101 is a blow-out preventer, or BOP 130. The BOP 130 is a large, specialized valve or set of valves used to control pressures during the drilling of oil and gas wells. Specifically, blowout preventers control the fluctuating pressures emanating from subterranean formations during a drilling process. The BOP 130 may include upper 132 and lower 134 rams used to isolate flow on the back side of the drill string 160. Blowout preventers 130 also prevent the pipe joints making up the drill string 160 and the drilling fluid from being pushed out of the wellbore 150 when a blowout threatens.

As shown in FIG. 1, the wellbore 150 is being formed down into the subsurface formation 155. In addition, the wellbore 150 is being shown as a horizontally-completed wellbore. Of course, this is merely illustrative as the wellbore 150 may be a vertical well. The inventions provided herein are not limited by the nature of the well completion unless expressly stated in the claims In drilling the wellbore 150, a first string of casing 110 is placed down from the surface 101. This is known as surface casing 110 or, in some instances (particularly for offshore operations) conductor pipe. The surface casing 110 is secured within the formation 155 by a cement sheath 115. The cement sheath 115 resides within an annular region between the surface casing 110 and the surrounding formation 155.

During the process of drilling and completing the wellbore 150, additional strings of casing will be provided. These may include intermediate casing strings and a final production casing string. For the final production casing, a liner may be employed, that is, a string of casing that is not tied back to the surface 101. In the illustrative wellbore of FIG. 1, an additional string of casing 140 is shown, along with an associated cement sheath 145.

In order to form a deviation (or "transitional section" 162) in the wellbore 150, a bottom hole assembly 170 is provided. The bottom hole assembly 170 is placed at a lower end of the drill string 160. The bottom-hole assembly 170 allows the operator to control or "steer" the direction or orientation of the wellbore 150 as it is formed. In this instance, the bottom hole assembly 170 is known as a rotary steerable drilling system, or RSS. The RSS is used in lieu of the mechanical kelly drive bushing 129 and rotary table once deviation 162 begins.

The bottom hole assembly 170 will include a drill bit 172. During the forming of the vertical section of the wellbore 150 the drill bit 172 is turned by rotating the drill string 160 from the platform 102 using the drive section 127 of the rotary table. Once the transitional section 162 starts, the drill bit 172 may be turned by using so-called mud motors 174. The mud motors 174 are mechanically coupled to and turn the nearby drill bit 172. The mud motors 174 are used with stabilizers or bent subs 176 to impart an angular deviation to the drill bit 172. This, in turn, deviates the well from its previous path in the desired azimuth and inclination.

The illustrative well site 100 also includes a sensor 178. Here, the sensor 178 is part of the bottom hole assembly 170. The sensor 178 may be, for example, a set of position sensors that is part of the electronics for a RSS. Alternatively or in addition, the sensor 178 may be a temperature sensor, a pressure sensor, or other sensor for detecting a downhole condition during drilling. Alternatively still, the sensor 178 may be an induction log or gamma ray log or other log that detects fluid and/or geology downhole.

The sensor 178 may be part of a MWD or a LWD assembly. It is observed that the sensor 178 is located above the mud motors 174. This is a common practice for MWD assemblies. This allows the electronic components of the sensor 178 to be spaced apart from the high vibration and centrifugal forces acting on the bit 172. Where the sensor 178 is a set of position sensors, the sensors may include three inclinometer sensors and three environmental acceleration sensors. Signals from the sensor may be input into a multiplexer and transmitted.

Regardless of the drilling drive system used or the orientation of the wellbore 150, the process of drilling through rock formations will generate "cuttings." Cuttings are chips of rock generated by the drill bit 172 that are brought back up to the surface 101 by the drilling mud. The cuttings are frequently delivered by a returns pipe 195 and dropped onto a so-called shaker table 190. The shaker table 190 operates to separate the drill cuttings from the mud as the fluid returns exit the back side of the drill string 160.

The shaker table 190 offers a screen, or a series of screens, capable of filtering the solid-rock chips making up the cuttings from the flowing mud returns. Those of ordinary skill in the art will understand that the size of cuttings produced at a well will depend on several factors including the geologic material being drilled through and the drill bit used. Particle sizes of cuttings can be, for example, as small as about 5 to 20 microns, but in some cases cuttings of 50 microns or larger may be experienced. Commonly, cuttings have a particle size of between about 0.5 mm to about 5-6 mm.

One of the problems commonly associated with shale shaker systems is limited efficiency in the sampling of cuttings. For example, analysis of the contents of the solid cuttings removed from the wellbore 150 is performed manually on discontinuous intervals after being sent to a lab. This results in only a partial understanding of what is being removed from the subsurface 155, and at a high cost, time and effort. Therefore, it is desirable to be able to analyze the cuttings as they are brought up to the shaker table 190 in real time.

BRIEF SUMMARY OF THE INVENTION

An analysis module for a shale shaker system is first provided herein. In one embodiment, the analysis module first comprises a container, or cuttings tank. The container is configured to receive a stream of drill cuttings suspended in the fluid returns at a well site. The drill cuttings are held in the tank for a brief period of time for analysis.

The container has an inlet for receiving the drill cuttings, and an outlet for releasing at least a part of the drill cuttings. In one embodiment, the inlet is proximate an upper end of the container, and the outlet is proximate a lower end of the container. In this instance, the outlet gravitationally receives the drill cuttings and fluid returns.

In another aspect, an upper outlet is provided to carry a majority of the return stream on to a shale shaker, while only a portion of the returns remain in the tank for analysis. Those captured cuttings pass through a lower outlet before being sent downstream for disposal or further processing.

In still another aspect, the container defines an elongated tubular body wherein a major axis of the tubular body is substantially horizontal. In this instance, the inlet is proximate a first end of the tubular body, and the outlet is proximate a second opposing end of the tubular body. Preferably, all fluid returns pass through the container.

The analysis module also includes at least two sensors. The sensors reside within the container. Preferably, the sensors comprise (i) a sonic log sensor, (ii) a gamma ray log sensor, (iii) a resistivity log sensor, (iv) a density log sensor, or (v) combinations thereof.

The analysis module also has a processor, or microcontroller. The processor is configured to receive electrical signals from the at least two sensors, with the processor having operating software to determine characteristics of the portion of the drill cuttings that pass through the container in real time. The data is processed and saved by the processor as Drill Cuttings Data.

Beneficially, the processor receives or, alternatively calculates, Depth Information. The Depth Information is indicative of an original location or depth of the drill cuttings as they pass through the container. The processor then associates the Depth Information with the Drill Cuttings Data.

In one aspect, the container comprises an intermediate chute. The chute is dimensioned to gravitationally release portions of the drill cuttings from the container as samplings. The intermediate chute may serve as one of the outlets for the container. The cuttings are released from the chute into a sampling chamber.

In one embodiment, drill cuttings are released into individual sample containers, such as translucent bottles, in the sampling chamber. Preferably, the containers are presented below the intermediate chute, individually as part of an automated cuttings sampling device. The automated cuttings sampling device may include a conveyor for transporting the bottles out of the sampling chamber as they are filled.

Preferably, the sampling chamber includes a camera. The camera takes digital images of the drill cuttings as they fall or otherwise move through the chute. In this instance, the sampling chamber may include appropriate lights to illuminate the sampling chamber as the cuttings are photographed. Preferably, the cuttings land onto a sieve table where they are washed prior to being photographed. The camera is configured to send digital files to a processor, wherein operational software identifies the lithology of the drill cuttings based on size, shape, color, or combinations thereof.

In a preferred embodiment, the sampling chamber takes only digital photographs for analysis without placing cutting samples into containers and without using a conveyor for transporting bottles. Thus, digital images become the samples.

In one embodiment, the processor is further configured to receive log data from a bottom hole assembly associated with a wellbore at the well site. This data is received or processed as Wellbore Data. The processor compares the Wellbore Data with Drill cuttings Data at corresponding depths to confirm that drill cuttings are being circulated to a surface of the well site. This ensures that drill cuttings are being properly cleaned from the wellbore during drilling.

A shale shaker system is also provided herein. In one embodiment, the shale shaker system comprises:

a fluid transport pipe configured to receive a stream of drill cuttings and fluid returns from a wellbore during a drilling operation;

an analysis module configured to receive the stream of drill cuttings and fluid returns at an inlet of the container;

a cuttings chute configured to receive the stream of drill cuttings and fluid returns from an outlet of the container, and deliver them to a screen box; and one or more screens for filtering drill cuttings from the fluid returns.

Generally, the analysis module is in accordance with the analysis module described above in its various embodiments. In this respect, the analysis module will include at least two logging sensors residing within the container and comprising (i) a sonic log sensor, (ii) a gamma ray log sensor, (iii) a resistivity log sensor, (iv) a density log sensor, or (v) combinations thereof. The logging sensors communicate with a processor to determine characteristics of the fluid returns and the drill cuttings in real time. The processor receives or, alternatively, calculates Depth Information indicative of a depth of the drill cuttings passing through the container, and associates the Depth Information with Drill Cuttings Data.

The shale shaker system preferably also includes a motor. The motor is configured to apply vibrational energy to the one or more screens during filtering. Filtering allows the operator to reclaim drilling mud which can then be recirculated into the drill string during drilling.

The shale shaker system preferably also includes a camera. The camera takes digital images of the drill cuttings as they fall or otherwise move through the container. In this instance, the container may include appropriate lights to illuminate the container as the cuttings are photographed. Preferably, the camera resides in a separate sampling chamber that receives the drill cuttings from the container. In this instance, the cuttings land onto a sieve table in the sampling chamber where they are washed prior to being photographed. In either instance, the camera is configured to send digital files to a processor, where operational software identifies the lithology of the drill cuttings based on size, shape, color, or combinations thereof.

A method of analyzing drilling fluid returns is also provided. In one aspect, the method first includes providing a shale shaker system. The shale shaker system is in accordance with the system described above.

The method also comprises receiving drill cuttings through the fluid transport pipe and into the analysis module. Additionally, the method includes determining characteristics of the fluid stream, including the drill cuttings, as they pass through the container in real time. The characteristics are saved by a processor as Drill Cuttings Data.

The analysis module comprises:

a container, at least two sensors residing within the container and comprising (i) a sonic log, (ii) a gamma ray log, (iii) a resistivity log, (iv) a density log, or (v) combinations thereof, and a processor configured to receive electrical signals from the sensors, with the processor having operating software to determine characteristics of the fluid returns and the drill cuttings passing through the container in real time, as the Drill Cuttings Data.

In one aspect, the processor receives or, alternatively, calculates information indicative of a depth of the drill cuttings passing through the container, and associates the information as Depth Information with the Drill Cuttings Data.

In one embodiment, the container of the analysis module comprises an intermediate chute. A portion of the drill cuttings falls through the intermediate chute and into a sampling chamber. The sampling chamber includes a camera. Using the camera, the method includes taking digital images of the drill cuttings as they fall or otherwise move through the chute. In this instance, the sampling chamber may include appropriate lights to illuminate the sampling chamber as the cuttings are photographed. Preferably, the cuttings land onto a sieve table where they are washed prior to being photographed.

In another aspect, the intermediate chute is dimensioned to gravitationally release portions of the drill cuttings to fill individual cuttings sample containers. In this instance, the method may further comprise:

providing an automated cuttings sampling device;

releasing the portions of the drill cuttings into the individual cuttings sample containers in response to the automated cuttings sampling device presenting individual cuttings sample containers below the intermediate chute.

Preferably, the inlet of the container is proximate an upper end of the container. A portion of the drill cuttings and fluid returns gravitationally fall into the container for sensing by the sensors. At the same time, a majority of the drill cuttings and fluid returns are conveyed to a cuttings chute for delivery to a shale shaker system or for disposal.

The method may additionally provide a step of comparing the log results of sensors taken in the analysis module with log readings taken by one or more sensors in a bottom hole assembly. The processor will compare the readings of the cuttings while they were downhole using the LWD tools with the readings of those same cuttings when they are at surface using the surface sensors. If the volumes and characteristics of the cuttings correlated with depth are the same, this indicates good hole cleaning.

BRIEF DESCRIPTION OF THE DRAWINGS

So that the manner in which the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

DETAILED DESCRIPTION OF CERTAIN EMBODIMENTS

Definitions

Figure 1:
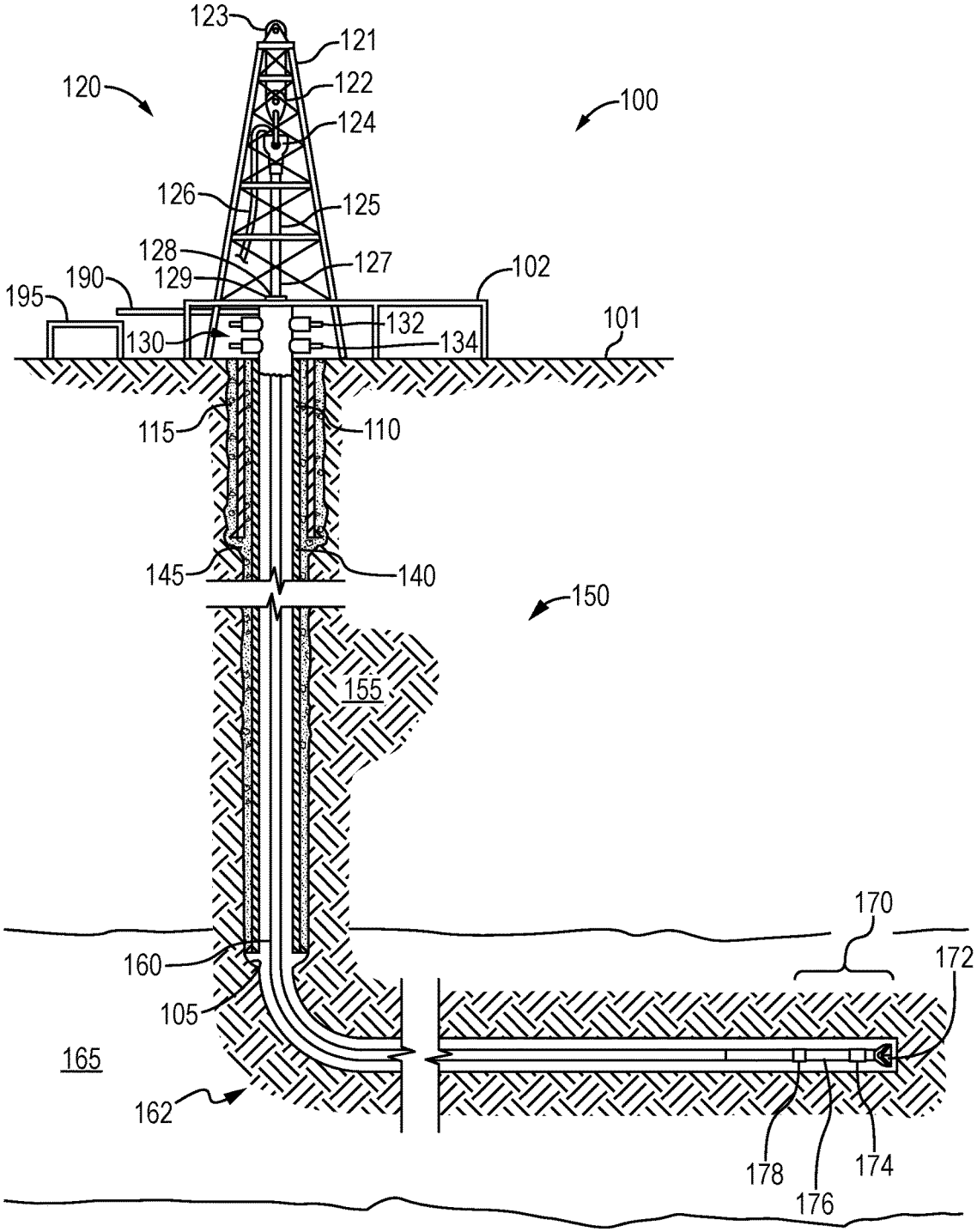
FIG. 1 is cross-sectional view of a wellbore being formed through a drilling process.

For purposes of the present application, it will be understood that the term "hydrocarbon" refers to an organic compound that includes primarily, if not exclusively, the elements hydrogen and carbon. Hydrocarbons may also include other elements, such as, but not limited to, halogens, metallic elements, nitrogen, oxygen, and/or sulfur.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions, or at ambient condition. Hydrocarbon fluids may include, for example, oil, natural gas, coalbed methane, shale oil, pyrolysis oil, pyrolysis gas, a pyrolysis product of coal, and other hydrocarbons that are in a gaseous or liquid state.

As used herein, the terms "produced fluids," "reservoir fluids" and "production fluids" refer to liquids and/or gases removed from a subsurface formation, including, for example, an organic-rich rock formation. Produced fluids may include both hydrocarbon fluids and non-hydrocarbon fluids. Production fluids may include, but are not limited to, oil, natural gas, pyrolyzed shale oil, synthesis gas, a pyrolysis product of coal, oxygen, carbon dioxide, hydrogen sulfide and water.

As used herein, the term "fluid" refers to gases, liquids, and combinations of gases and liquids, as well as to combinations of gases and solids, combinations of liquids and solids, and combinations of gases, liquids, and solids.

As used herein, the term "wellbore fluids" means water, hydrocarbon fluids, formation fluids, or any other fluids that may be within a wellbore during a production operation.

As used herein, the term "gas" refers to a fluid that is in its vapor phase.

As used herein, the term "subsurface" refers to geologic strata occurring below the earth's surface.

As used herein, the term "formation" refers to any definable subsurface region regardless of size. The formation may contain one or more hydrocarbon-containing layers, one or more non-hydrocarbon containing layers, an overburden, and/or an underburden of any geologic formation. A formation can refer to a single set of related geologic strata of a specific rock type, or to a set of geologic strata of different rock types that contribute to or are encountered in, for example, without limitation, (i) the creation, generation and/or entrapment of hydrocarbons or minerals, and (ii) the execution of processes used to extract hydrocarbons or minerals from the subsurface.

As used herein, the term "wellbore" refers to a hole in the subsurface made by drilling or insertion of a conduit into the subsurface. A wellbore may have a substantially circular cross section, or other cross-sectional shapes. The term "well," when referring to an opening in the formation, may be used interchangeably with the term "wellbore." The term "bore" refers to the diametric opening formed in the subsurface by the drilling process.

DESCRIPTION OF SELECTED SPECIFIC EMBODIMENTS

Figure 2:
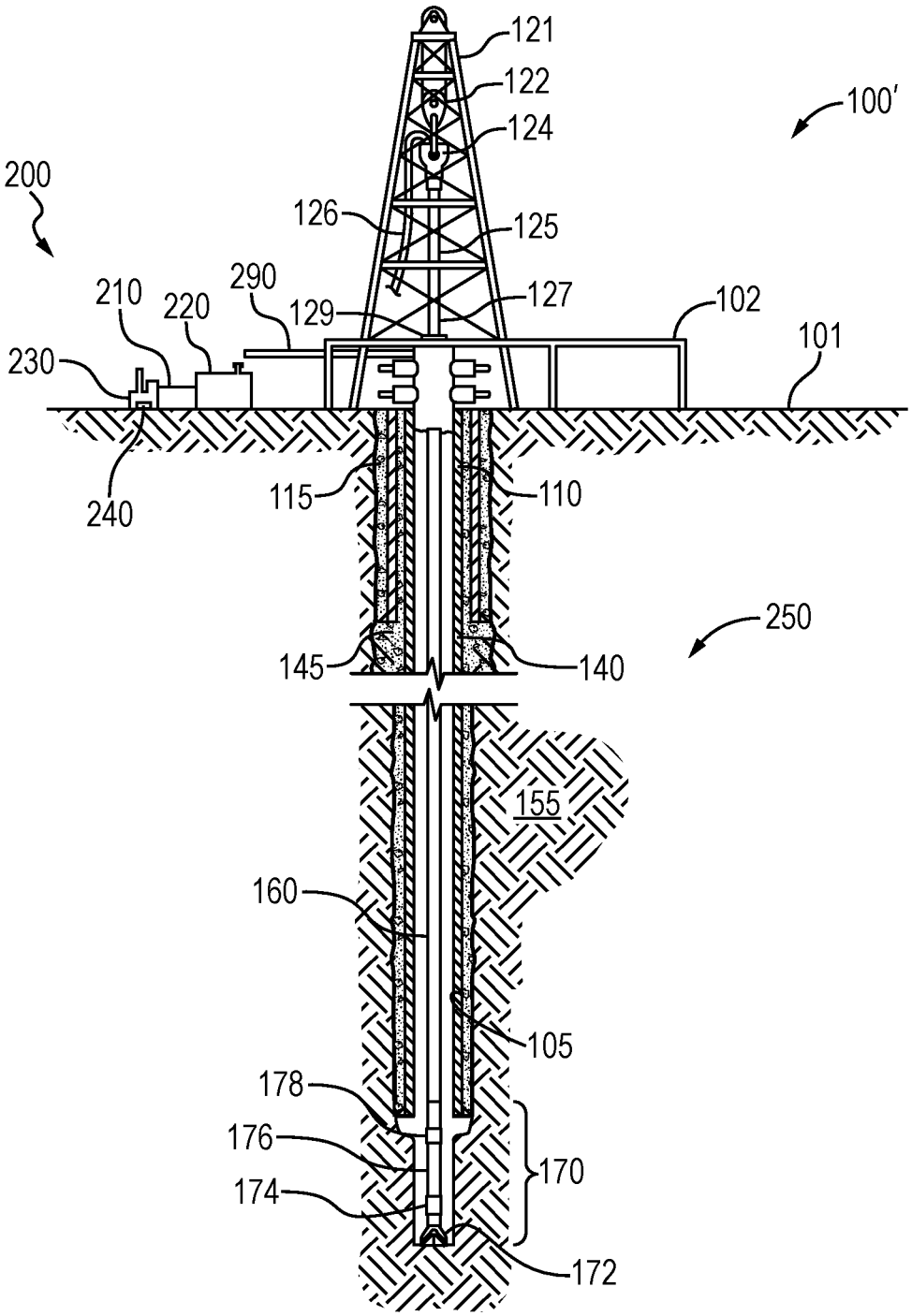
FIG. 2 is a side view of a wellbore. The wellbore is being formed using a drilling rig, such as rig from FIG. 1. In this instance, an analysis module is provided at the well site for analyzing drill cuttings in real time.

FIG. 2 is a side view of a wellbore 250. The wellbore 250 is being formed using a drilling rig, such as rig 120 from FIG. 1. The rig 120 operates at a well site 100'. In the view of FIG. 2, the wellbore 250 has only been completed thus far in a vertical orientation. However, it is understood that the vast majority of wells being drilled in the United States today are completed horizontally, and that wellbore 250 may also be completed horizontally as shown in FIG. 1.

It is observed that a shale shaker system 200 is provided at the surface 101 of the well site 100'. During drilling, fluids travel through the mud hose 126, down the drill string 160, down to the drill bit 172, back up the back side of the drill string 160, to the surface 101, and into a cuttings transport line 290. The transport line 290 is the same as transport line 190 of FIG. 1. However, in the view of FIG. 2 the transport line 290 is delivering fluid returns to a novel shale shaker system 200. The fluids form a return stream that represents drilling mud, drill cuttings and possible formation fluids.

The return stream empties from the cuttings transport line 290 into an analysis module 220.

Figure 3:
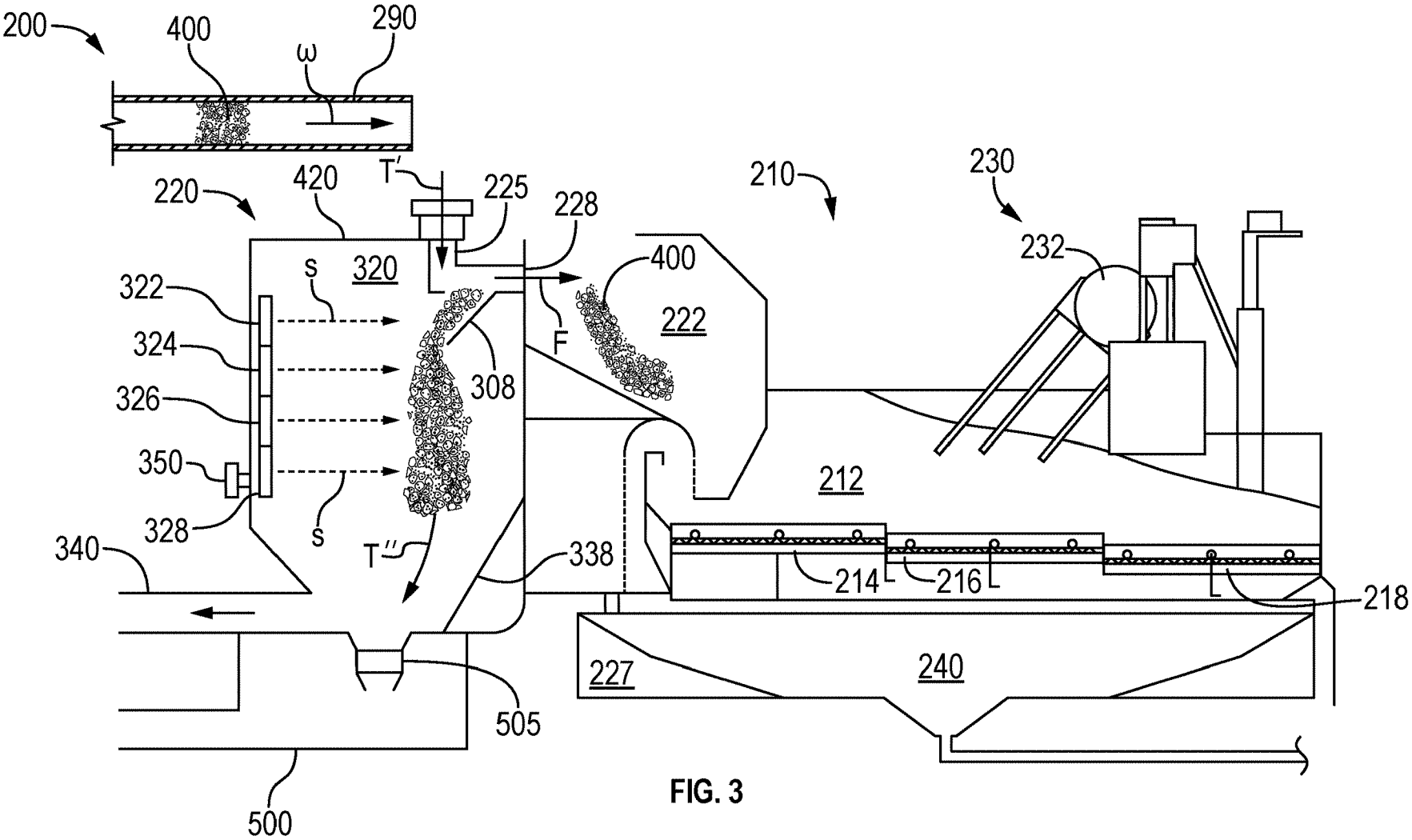
FIG. 3 is an enlarged view of the shale shaker system of the present invention, in one embodiment.

FIG. 3 is a more detailed schematic view of the shale shaker system 200 of FIG. 2. The shale shaker system 200 first includes the analysis module 220. The analysis module 220 defines a container, or cuttings tank 420. The shale shaker system 200 additionally includes a shale shaker 210, a vibration system 230 that imparts mechanical wave energy to sieve tables 212 associated with the shale shaker 210, and a mud returns tank 240.

Figure 4:
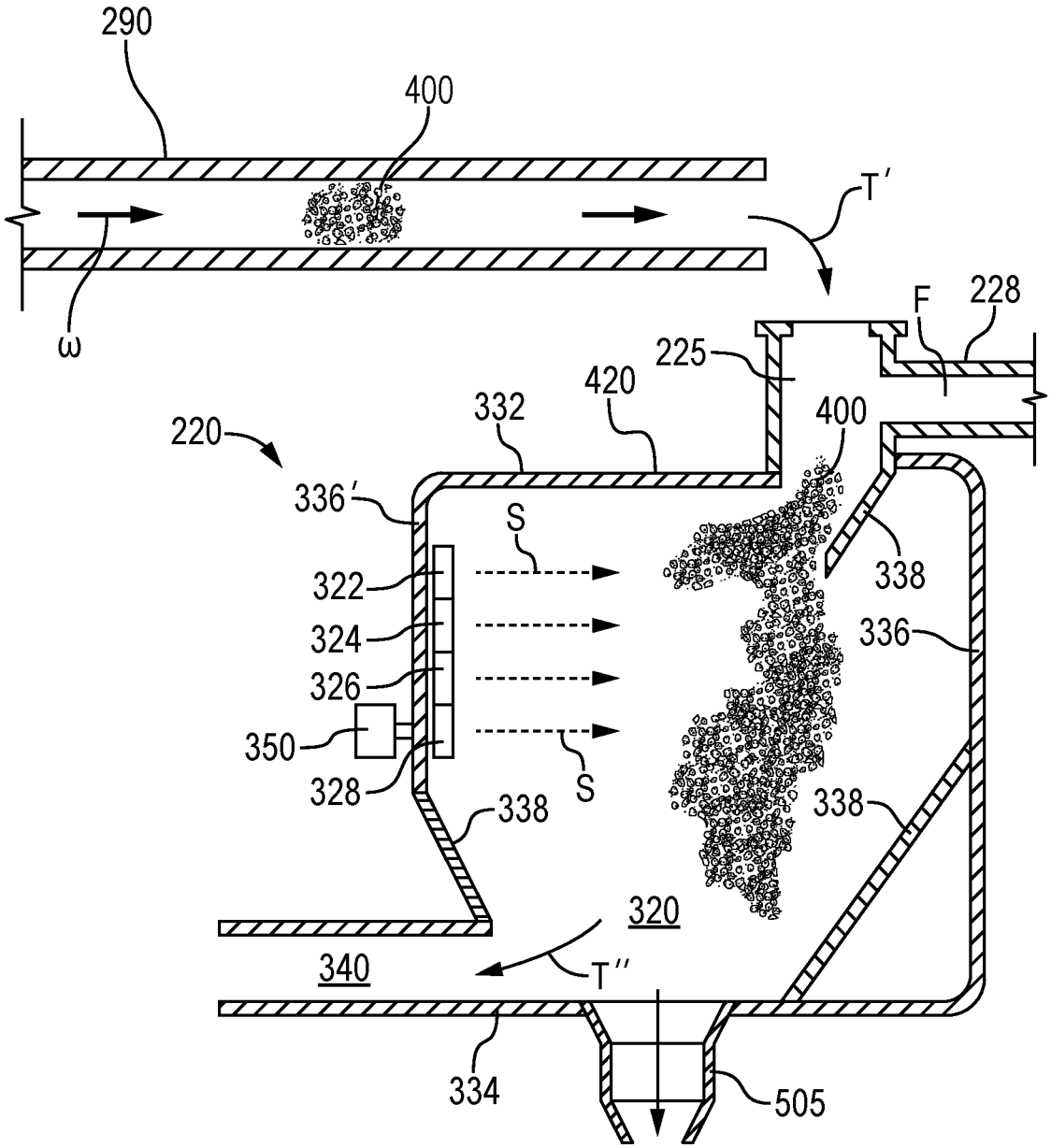
FIG. 4 is a side, cross-sectional view of the analysis module of the shale shaker system of FIG. 3, in one embodiment.

FIG. 4 is an enlarged, cross-sectional view of the analysis module 220 of the shale shaker system 200 of FIGS. 2 and 3. As noted, the analysis module 220 defines a tank 420 for holding cuttings 400. The cuttings tank 420 is configured to receive drill cuttings, or "shale," from the cuttings transport line 290. Illustrative cuttings are shown at 400 in both the line 290 and the tank 420.

The cuttings tank 420 comprises an inlet 225. The inlet 225 receives drill cuttings 400 from the cuttings transport line 290 and directs them into an internal chamber 320. Arrow "W" shows cuttings 400 moving through the transport line 290. Arrow T then shows a path for cuttings 400 into the chamber 320 of the cuttings tanks 420. It is understood that an elbow or t-valve or other connection will be provided between the cuttings transport line 290 and the inlet 225.

The cuttings tank 420 is preferably fabricated from steel or other heavy duty material suited for the drill site environment. The cuttings tank 420 defines an open volume 320 formed by an upper wall 332, a lower base 334 and one more side walls 336, 336'. Various directional walls 338 may also be provided to direct cuttings 400 as they fall into the volume 320 and proceed through a lower exit 340.

In one embodiment of the cuttings tank 420, an upper outlet 228 is provided for diverting a majority of the cuttings 400. A portion of the cuttings 400 travel into the analysis module 220 for interrogation, passing along path T' and then through door 308. In another aspect, particularly where the shale shaker 210 is not used, all drill cuttings 400 will enter the tank 420 according to path T', and then exit through lower outlet 340 through path T".

In either aspect, a plurality of sensors is located along a side wall 336' of the cuttings tank 420. The sensors may include one or more of a sonic log 322, a gamma ray log 324, a resistivity log 326 and a density log 328. In the arrangement shown in FIGS. 3 and 4, the sensors 322, 324, 326, 328 are arranged in a linear array. Specifically, they are stacked one on top of the other.

Preferably, an access port (not shown) is provided along the wall 336'. The access port serves as a door that enables the operator to install, maintain and replace the sensors 322, 324, 326, 328. Preferably, the sensors 322, 324, 326, 328 are mounted directly onto an inner surface of the access port. Beneficially, the sensors 322, 324, 326, 328 do not need to be fabricated to withstand high temperatures or high pressures, unlike sensors used for downhole logging tools.

Concerning the individual sensors themselves, the sonic log 322 operates on the basis of sound signals. The sonic log 322 has two primary components—a transmitter and a receiver. In some cases, the receiver is an array of microphones. The transmitter emits sound waves while the receiver receives echoes of the sound waves as they bounce off of the drill cuttings 400. The transmitter and the receiver are spaced apart from each other (typically one at the very top and the other at the bottom) along the sonic logging tool 322 to give time for the sound waves to move from the transmitter, then hit the cuttings 400, and then echo back to the receiver.

The sonic log sensor 322 is designed to measure the speed of sound relative to various materials. Specifically, the sonic log sensor 322 has associated waveform processing software. The sound waves generated by the source (transmitter) hit the cuttings (solid returns from the wellbore) and are reflected back to the receivers where the sound pulses are detected. The difference (or delta) in time taken for the sound to travel from the transmitter to the receiver is recorded by the sonic log sensor 322. This delta-time property is specific for each rock type and will allow the operator (with the help of the software) to understand the lithology of the cuttings 400 being transported to the surface at each given depth. Possible rock types that may be recognized by the software include carbonates, shale and sandstone.

A possible sonic sensor 322 for use in the analysis module 220 is the Baker Hughes PA probe, 5 MHz, 16 el, P 1×10 mm.

The gamma ray log sensor 324 is a passive tool, that is, it does not emit sound waves or radiation; instead, the gamma ray log sensor 324 measures the natural radiation, or isotopes, emitted by the returning drill cuttings 400. Preferably, the gamma ray log sensor 324 is a Spectral Gamma Ray, or "SGR" log. The SGR log can measure and categorize the natural radiations of the cuttings 400. For example, the SGR log can differentiate the type of radiation coming out of cuttings 400 into percentages of Potassium (K), Uranium (U) and Thorium (TH).

An example of a gamma ray sensor 324 for use in the analysis module 220 is the AMETEK—GAMMA-RADS Gamma Ray Detection System.

The resistivity sensor 326 is a logging tool that is designed to emit an electric current through the cuttings 400 and then measure the resistivity of the material. Oil-pore-filled-cuttings will have a high resistivity while cuttings with water filled pores will have a low resistivity. This is because hydrocarbons are considered insulators while water (or at least brine) conducts electricity.

An example of a resistivity log sensor 326 that may be used in the analysis module 220 is the CDE 681 Series Conductivity/Resistivity Sensor. This sensor is available from Omega Engineering, Inc. of Stamford, Conn.

The density sensor 328 is a logging tool configured to measure the density of the cuttings 400 based on radiometric measurements. A transmitter is provided that emits low-energy gamma rays at user-safe levels. An analyzer receives the rays as they are reflected off of the cuttings 400 and determines the density. After the density is determined, together with the other logs the lithology can be better identified.

An example of a density log sensor 328 that may be used in the analysis module 220 is the SENS series LB 480. This sensor is available from Berthold Technologies USA, LLC of Oak Ridge, Tenn.

Additional sensors may be deployed in the analysis module 220 including, for example, a temperature sensor or a neutron log sensor. Each sensor 322, 324, 326, 328 is in electrical communication with a processor 350. The processor 350 ideally resides outside of the cuttings tank (or analysis module) 420, such as on the opposite side of the wall 336'.

Each of the sensors 322, 324, 326, 328 emits and/or receives signals, shown at "S." The signals S measure properties of the cuttings 400. The properties are detected according to the operation of the sensors 322, 324, 326, 328 as outlined above. Output signals are then sent to the processor 350 for processing. The processor 350 may be a host micro-controller that receives output signals from the sensors over a wire bus (electrical wires).

In one aspect, the sensors 322, 324, 326, 328 provide the measured data output in user-configurable bit size data corresponding to the desired resolution. In this way, Drill Cuttings Data is generated for analysis. Beneficially, the shale shaker system 200 allows for a continuous evaluation of the fluid stream and cuttings exiting the wellbore 250 during the drilling process.

Figure 3A:
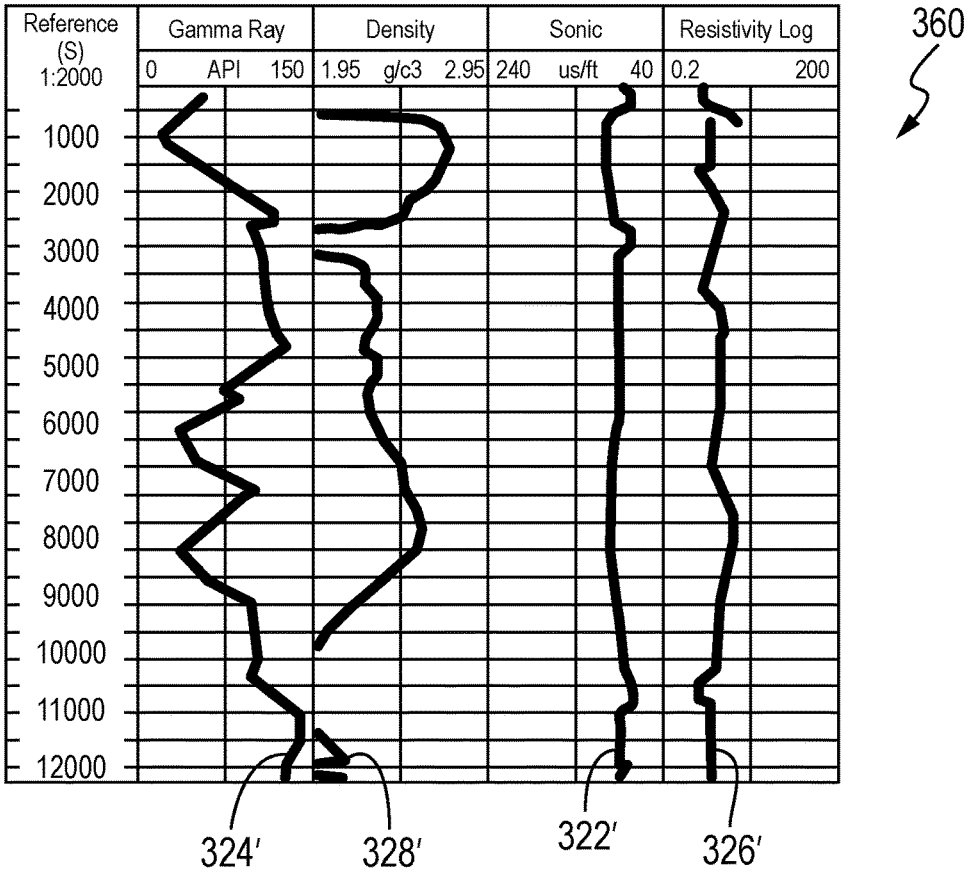
FIG. 3A is an illustrative log of sensor readings from the analysis module of the shale shaker system of the present invention. Log readings from each of four sensors is provided as a function of total depth. This is an example of Drill Cuttings Data.

FIG. 3A is an illustrative logging chart 360. Log readings from each of the four sensors 322, 324, 326, 328 are provided as a function of total depth. Readings from a sonic sensor 322 are shown at 322'; readings from a gamma ray log 324 are shown at 324'; readings from a resistivity log are shown at 326'; and readings from a density sensor 328 are shown at 328'. All of the readings are referenced to time in seconds; that is to say, the cuttings at the surface at a certain time S, measured in seconds, has the following log properties.

Figure 3B:
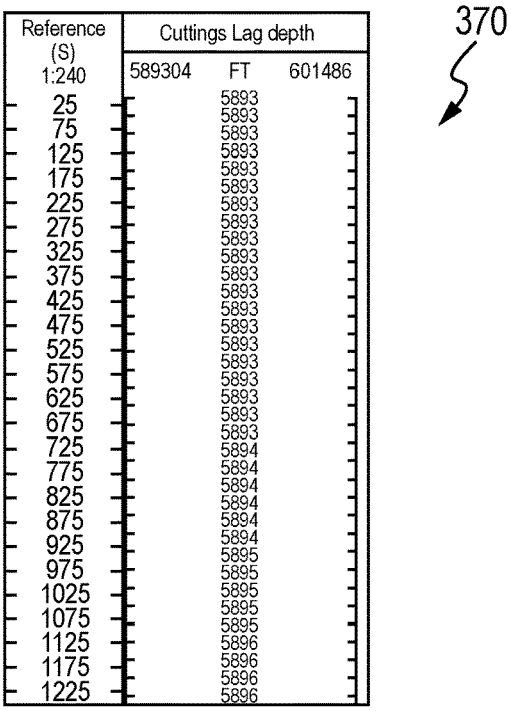
FIG. 3B is a log of cuttings depth. This is an example of Depth Information for drill cuttings as they arrive at the surface.

FIG. 3B is an illustrative logging chart 370. Cutting lag depth is shown as a function of time reference. Note that if the driller does not drill further into the hole for some time, then the time continues to advance (go up) while the cuttings lag depth doesn't change as the driller is getting cuttings from the same depth.

Figure 3C:
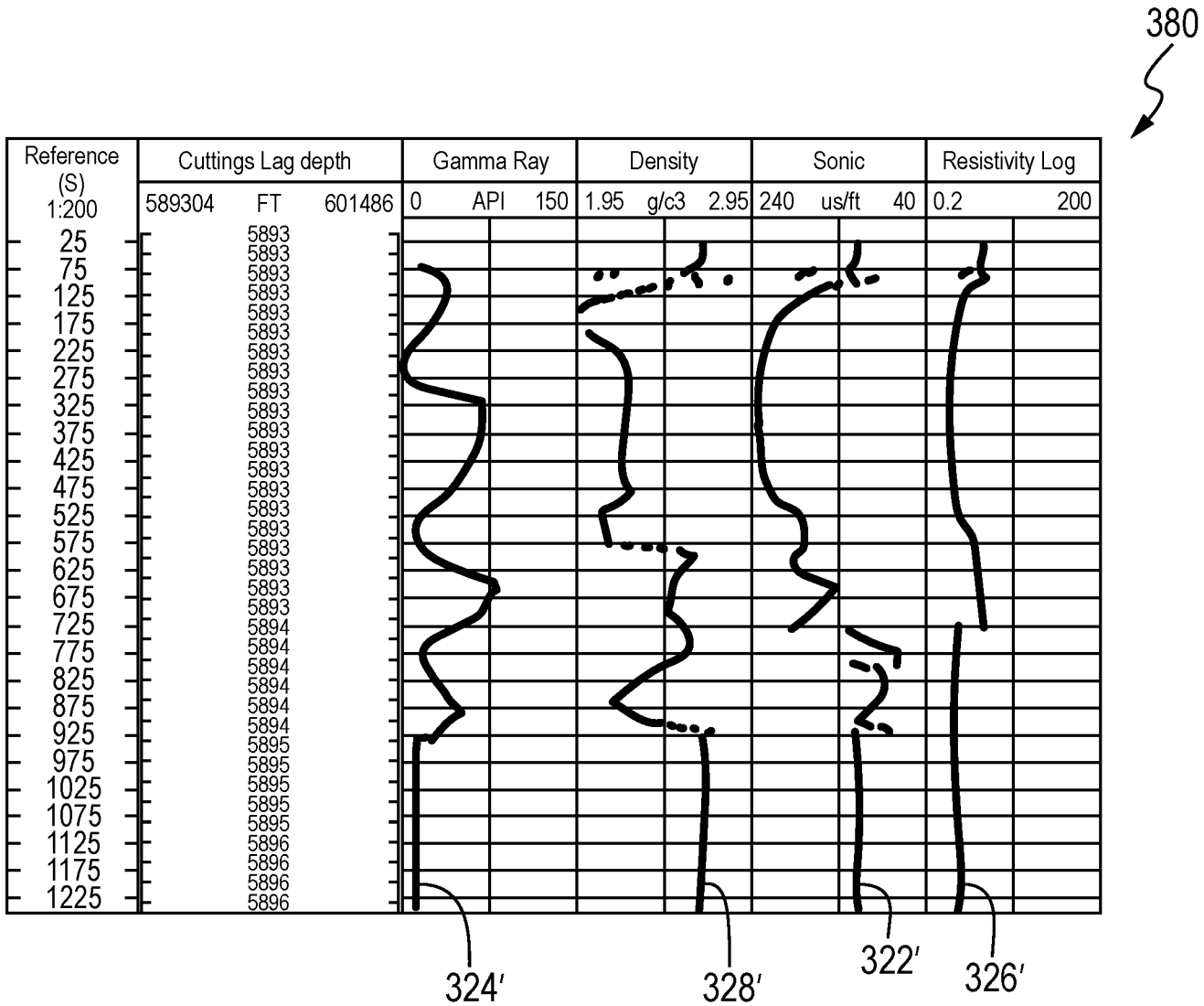
FIG. 3C is a combined log chart and depth chart. Cuttings depth is correlated with sensor information at equivalent times.

FIG. 3C presents a combined log 380 wherein cuttings lag depth is correlated to the various sensor readings. FIG. 3C correlates depth data with sensor readings at equivalent times. In other words, it assigns the log sensor readings 360 to the cutting depths readings 370 at equivalent times to create the combined log 380.

In one aspect of the invention, cuttings 400 exit the tank 420 through exit 340, according to path T'. At the same time, a portion of the cuttings 400 will enter a sampling chamber below the cuttings tank 420.

Figure 5A:
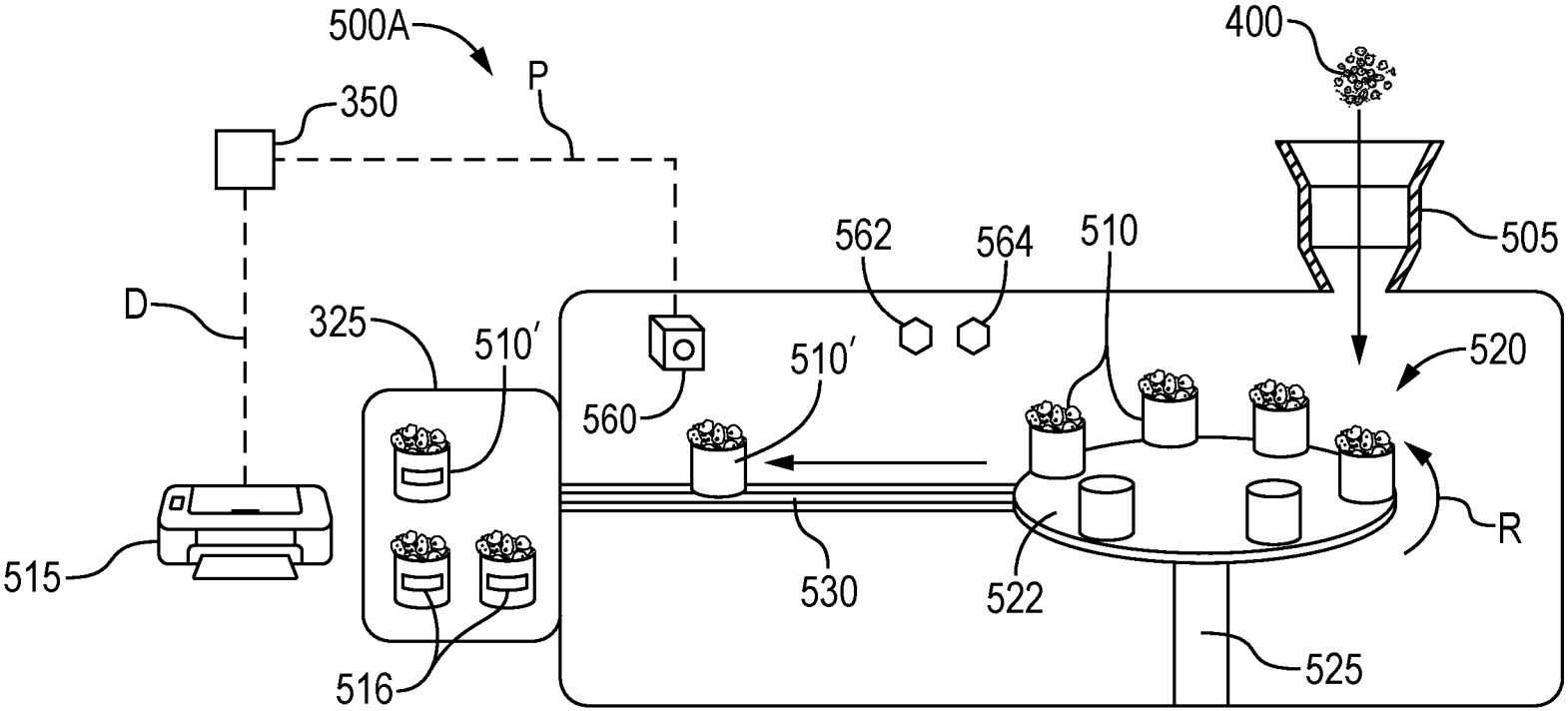
FIG. 5A is a perspective view of a return cuttings sampling device of the shale shaker system of FIG. 3. The sampling device resides within a sampling chamber below the analysis module. Cuttings fall through a chute and into individual containers.

FIG. 5A is a somewhat schematic, perspective view of a return cuttings sampling chamber 500A of the shale shaker system 200 of FIG. 3. The sampling device 500A offers an intermediate chute 505. The chute 505 is associated with outlet 340 of FIG. 4, and is dimensioned to gravitationally receive a portion of the cuttings 400 from the cuttings tank 420 en route to the outlet 340.

The cuttings 400 fall through the inlet 505 and are dropped into separate sampling bottles 510. The bottles 510 are preferably fabricated from a durable poly carbonate material. Preferably, the material of the bottles 510 is translucent, permitting the operator to visually confirm the presence of cuttings 400 in each of the bottles 510.

A conveyance system 520 is provided for feeding cuttings 400 into the bottles 510. In the illustrative arrangement of FIG. 5A, a rotary table 522 is provided. The rotary table 522 turns at intervals, delivering the bottles 510 in sequence to a position below the inlet 505. The bottles 510 are then dropped onto a conveyor belt 530 where they exit to a collections point 325.

In one aspect, an operator manually labels the bottles 510' as they are delivered to the collections point 325. More preferably, a printer 515 prints out labels in response to depth signals "D" provided by the rig 125. The labels correlate to a calculated depth from which the samples were taken. In this way, the shale shaker system 200 will automatically sample the cuttings 400 into labelled bottles 510' and provide accurate labels, all in real time.

The depth may be determined using known correlations between pump volumes, wellbore depth and time. This is referred to as "lag depth." If for example the cutting lag depth at 332,451 seconds is 4,500 feet, that means at that time the cuttings drilled from 4,500 feet are at the surface in the shakers 210. This Depth Information is typically available from the rig 120.

In still another aspect of the shale shaker system 200, the printer 515 will also print out data derived by the processor 350 in response to processing signals "S." Such data may include (i) the type of rock present in the cuttings 400, (ii) the presence of water, (iii) the presence of hydrocarbons, or (iv) combinations thereof. Thus, the shale shaker system 200 automatically samples the cuttings in the labeled bottes 510 rather than using manual-human-sampling common in the art, and further provides data concerning the contents of each bottle 510' including depth and type of material 400 exiting the bore hole 150.

Empty bottles 510 have to be refilled manually on their allocated locations on the rotary table 522 according to the sampling rate required.

The processor 350 is designed to link the time-based sensor readings of FIG. 3A to the lag depth references from the rig of FIG. 3B, at each equivalent time. FIG. 3C presents a combined log 380 wherein cuttings lag depth is correlated to the various sensor readings. Readings from a sonic sensor 322 are again shown at 322'; readings from a gamma ray log 324 are shown at 324'; readings from a resistivity log are shown at 326'; and readings from a density sensor 328 are once again shown at 328'.

In one aspect, the sampling chamber 500A also includes a camera 560. The camera 560 takes a photograph of each sample 510' as it leaves the rotary table 522. To assist in accurate photography, light bulbs 562 and/or UV lights 564 may be provided. The light bulbs 562 may be halogen, CFL or incandescent bulbs, for example.

It is understood that the conveyance system 520 of FIG. 5A is an optional feature. The sampling chamber 500A may alternatively catch the portion of drill cuttings 400 as they fall through the inlet 505 and photograph samples without actually placing them in containers 510.

Figure 5B:
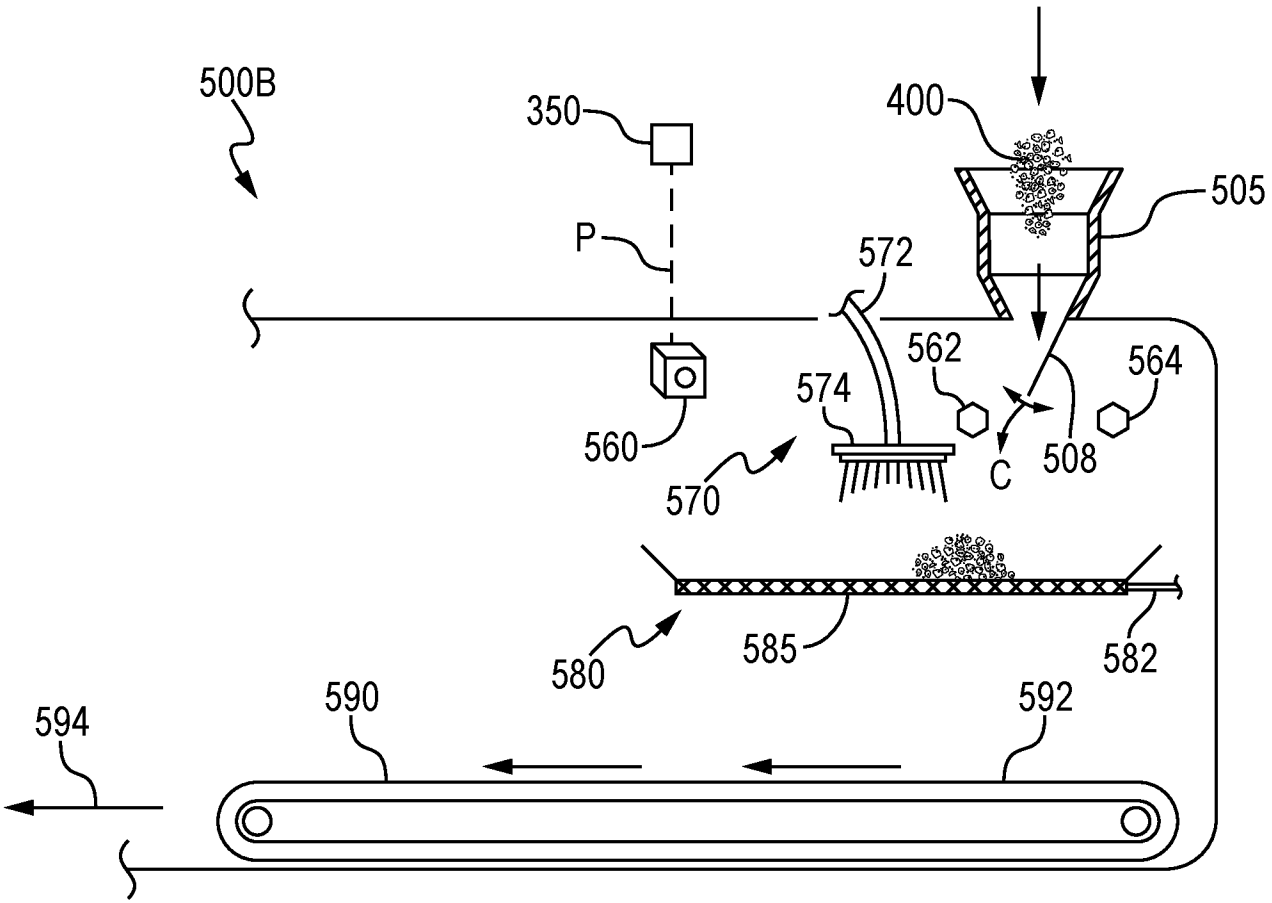
FIG. 5B is a side, schematic view of a sampling chamber in an alternate embodiment. Here, cuttings cyclically fall through a chute and onto a sieve table.

FIG. 5B provides a sampling chamber 500B wherein samples are not actually placed in containers. The sampling chamber 500B includes the inlet 505 for receiving drill cuttings 400 from the analysis module 220. In one aspect, the inlet 505 includes a door 508 that opens and closes according to Arrow C at user-selected intervals. For example, the door 508 may automatically open for 5 seconds, allowing cuttings to flow in at every 50-foot interval.

The sampling chamber 500B also includes the light 562 and the UV light 564. The lights 562, 564 illuminate the cuttings 400. In addition, the sampling chamber 500B includes the camera 560. The camera 560 photographs samples at selected time intervals. In one aspect, four photographs are taken of each sample, and digital files are sent to the processor 350. The processor 250 then associates the photographs with the corresponding lag depth from FIG. 3B.

In operation, the cuttings 400 fall through the inlet 505 and onto a shaker table 580. The shaker table includes a vibrating sieve plate 585. A cleaning system 570 is provided to wash the cuttings 400 with a continuous spray of water. The watering system 570 includes a hose 572 and a shower head 574 or other outlet. As cuttings 400 fall onto the sieve plate 585, the cuttings 400 are washed for presentation to the camera 560. Ideally, the sieve table 580 is programmed to stop vibrating at the instance the pictures are taken, allowing for a better photo quality.

The sampling chamber 500B also includes a disposal track 590. The disposal track 590 may be a conveyor belt having an infinite surface 592 that receives and transports the cuttings 400 out of the sampling chamber 500B. From there, the cuttings 400 are moved to the rig's 120 main disposal line (not shown).

The sieve plate 585 may include a shaft 582. The shaft 582 is turned by a motor (not shown) 180° to release the photographed cuttings. Alternatively, the shaft 582 may be turned manually using a handwheel (also not shown). When the door 508 is closed, the motor is activated, turning the shaft 582 and connected sieve plate 585 upside down. In this way, the sampled cuttings 400 are dumped onto the disposal track 590 and the shaker table is ready to receive a new sample of cuttings 400. A small solid/liquid pump may be provided to clean the bottom of the sieve plate 585.

The processor 350 may include digital image analyzing software. The software is used to analyze the cuttings' shape and structure, in this way, the software can identify the material of the cuttings 400 at selected depths. The cuttings may define shale, carbonates, sandstone, or other lithology. Such software is available, for example, from TotalLab in Newcastle Upon Tyne, UK.

Returning to FIG. 3, it is observed that the shale shaker system 200 includes other components, which may be known to the geologist and driller. These include first a feeding chute 222. The feeding chute 222 receives that portion of cuttings 400 that does not empty into the interior volume 320 of the cuttings tank 420. The cuttings 400 are fed by outlet 228. This may actually be the vast majority of the cuttings 400 from the cuttings transport line 290.

The shale shaker system 200 will also include a so-called screen box 212. The screen box 212 holds a series of screens 214, 216, 218. Each screen 214, 216, 218 may have a different filter gauge, permitting progressively larger rock chips to be released and analyzed. The screens 214, 216, 218 are also configured to permit a gravitational release of cuttings 400 from one screen to the next.

The screens 214, 216, 218 sit over a base 227. The base 227 is configured to direct drilling fluids into a catch tank 240. The catch tank 240 may direct drilling fluids back to a holding tank for processing and, optionally, re-use.

Finally, the shale shaker system 200 will include a vibration system 230. The vibration system 230 includes one or more motors 232 that create mechanical wave energy and direct it to the screen box 212 or to the individual screens 214, 216, 218. The vibration system 230 may be any known system for imparting the desired mechanical energy.

In the analysis module 200, a portion of drill cuttings 400 are taken for analysis by the sensors 322, 324, 326, 328 and, optionally, by the camera 560. Alternatively, and as shown in the module 220 of FIGS. 3 and 4, only a portion of the cuttings 400 are taken for the analysis, with most of the cuttings 400 being delivered to the box. In yet another arrangement, all cuttings 400 pass through a tubular analysis module that resides in series with the cuttings transport line 290. In the alternative arrangement, the sensors 322, 324, 326, 328 are housed in a generally horizontal tubular body that resides between the transport line 290 and the shale feeding chute 222. The chute 222 serves as an inlet for the shale shaker 210.

Figure 6:
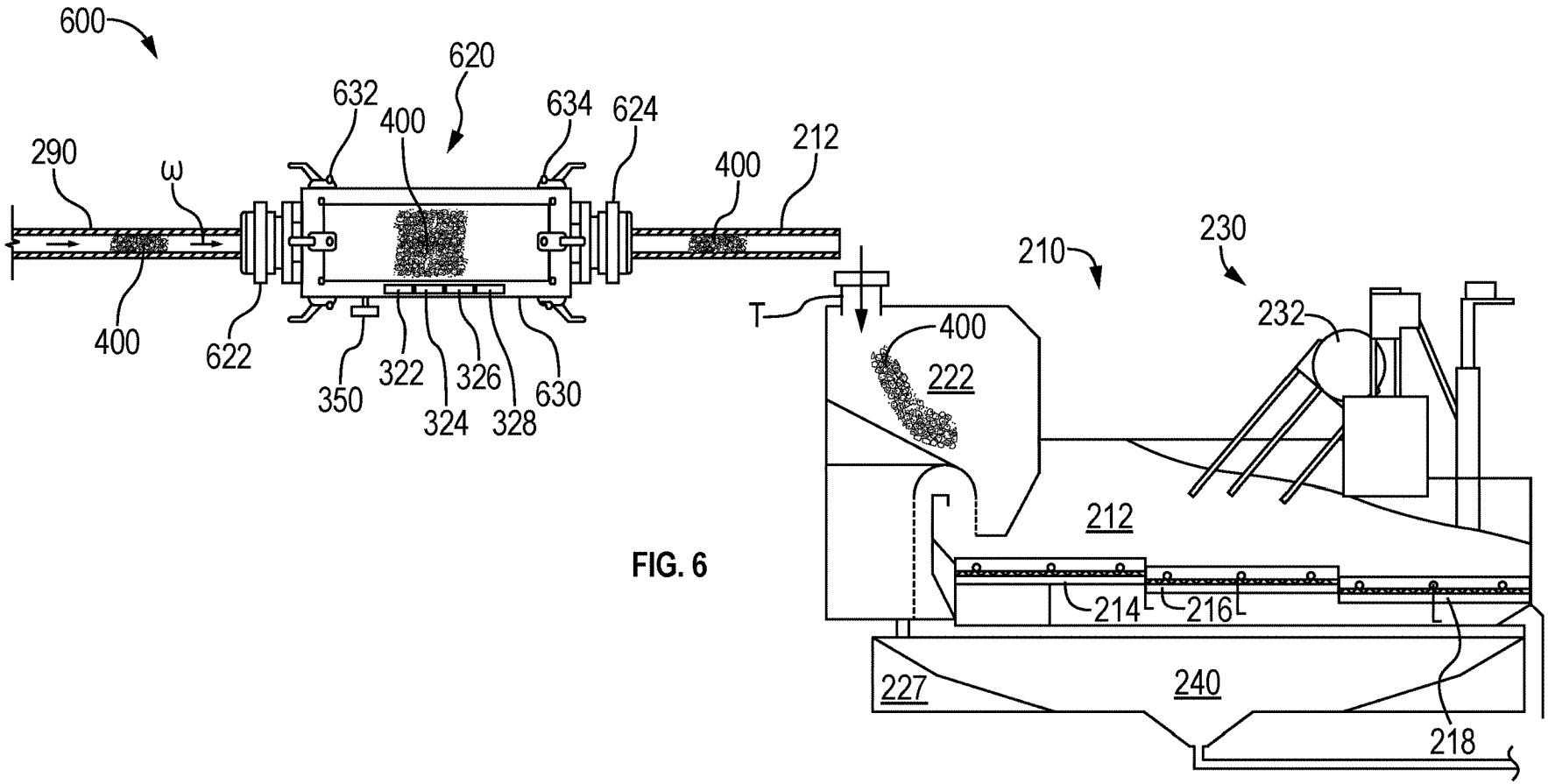
FIG. 6 is side view of an analysis module for the shale shaker system of FIG. 2 in an alternate embodiment. Here, the analysis module is a tubular pipe connector configured to deliver cuttings to a shale shaker.

FIG. 6 is side view of the shale shaker system 600 in the alternate embodiment. It can be seen that cuttings transport line 290 is moving cuttings in accordance with Arrow "W." FIG. 6 also shows a shale shaker 210 being acted upon by a vibration system 230. FIG. 6 additionally shows a catch tank 240 for catching drilling fluid returns. Finally, FIG. 6 shows an analysis module 620.

The analysis module 620 is designed to be used on any conventional shale shaker to analyze the cuttings as they pass through the shaker's inlet 222.

In the shale shaker system 600, the analysis module 620 defines a tubular body 630 having a first end 632 and a second opposite end 634. The first end 632 includes a connector 622 for placing the pipe 290 in sealed mechanical and fluidic connection with the analysis module 620. Similarly, the second end 634 includes a connector 624 for placing the chute 212 in sealed mechanical and fluidic connection with the analysis module 620. The tubular body 630 serves as a container for receiving and analyzing drill cuttings and fluid returns.

Figure 7A:
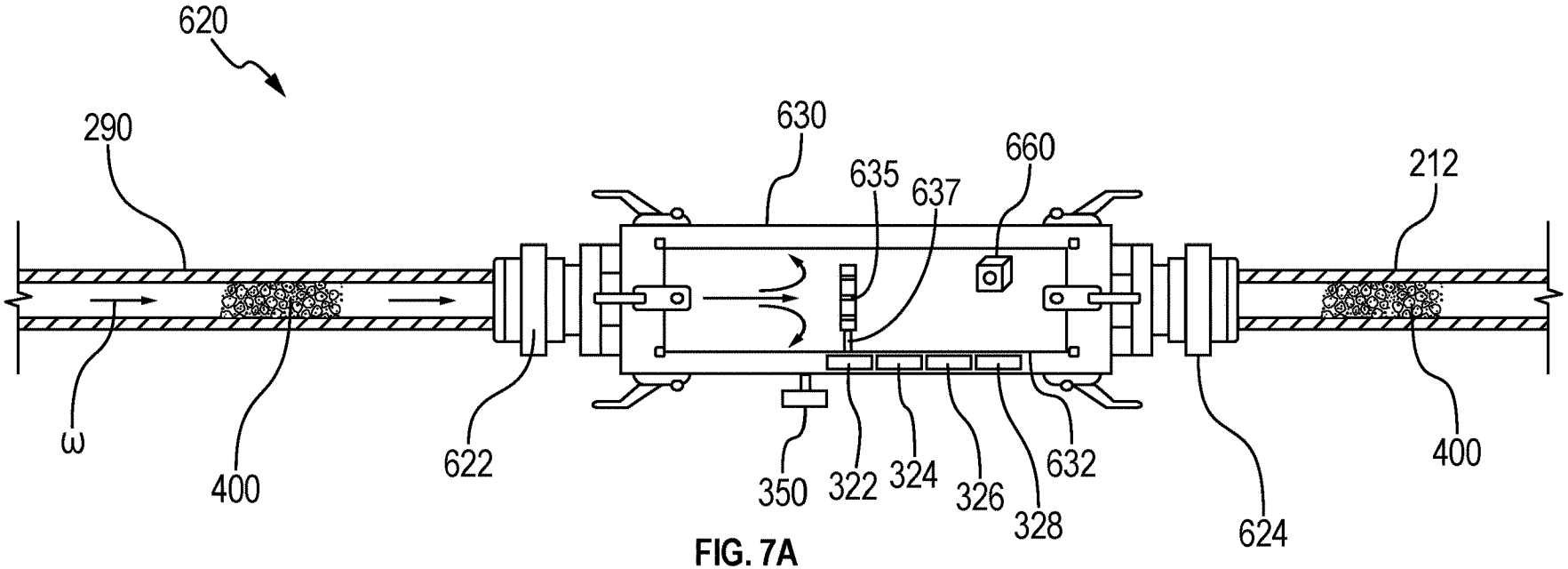
FIG. 7A is cutaway view of the analysis module of FIG. 6. A cutting filter screen is shown, with the cutting filter screen being set in its raised, or "On" position.

FIG. 7A is cross-sectional view of the analysis module 620 of FIG. 6. Here, the opposing connectors 622, 624 are better seen. Also of interest, a cutting filter screen 635 is shown. In this view, the cutting filter screen 635 is moved into its operating, or "On" position. The cutting filter screen 635 serves as a strainer gate. The cutting filter screen 635 comprises a porous filter that filters a portion of the solid cuttings from the liquid flow "W." This allows a short time accumulation of cuttings 400 on the gate 635. The sensors 322, 324, 326, 328 then take their respective readings and send signals on to the processor 350.

Figure 7B:
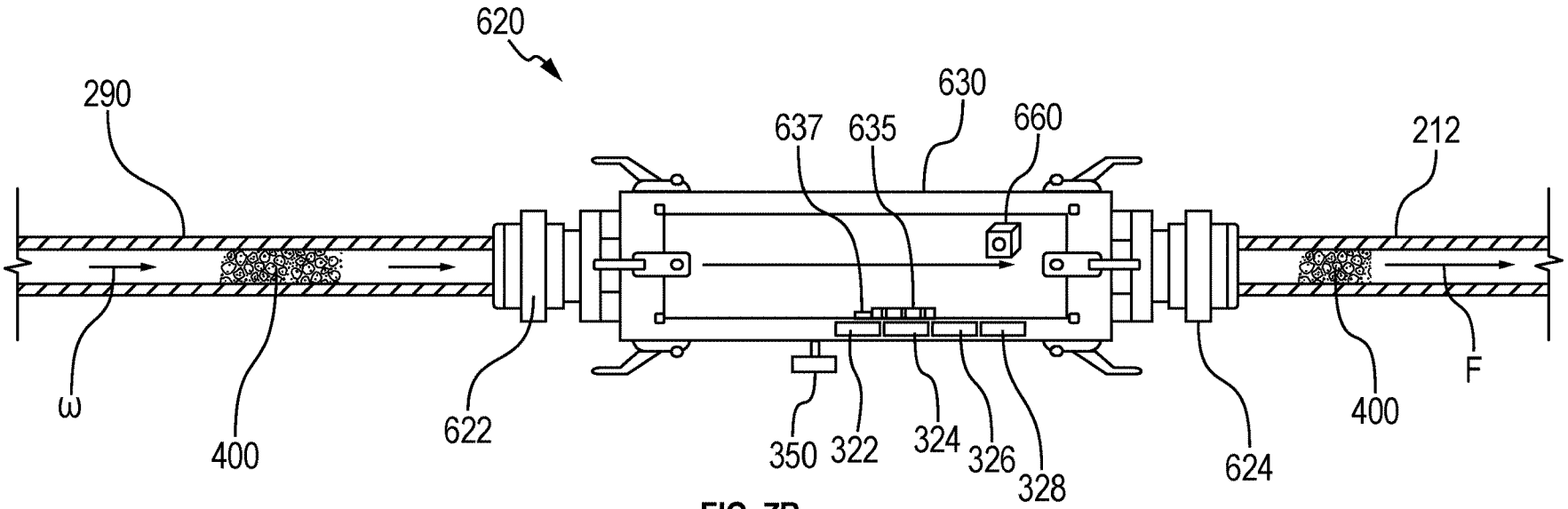
FIG. 7B is another cutaway view of the analysis module of FIG. 6. Here, the cutting filter screen has been lowered to an "Off" position.

FIG. 7B is another cross-sectional view of the analysis module 620 of FIG. 6. Here, the cutting filter screen 635 is moved to an "Off" position. In this position, the gate 635 does not impede the flow "W" of drill cuttings to the chute 212 of the shale shaker 210. Fluid returns flow on through the analysis module 620 and to the screen box 212, preferably with the sensors 322, 324, 326, 328 being temporarily turned off.

Figure 8A:
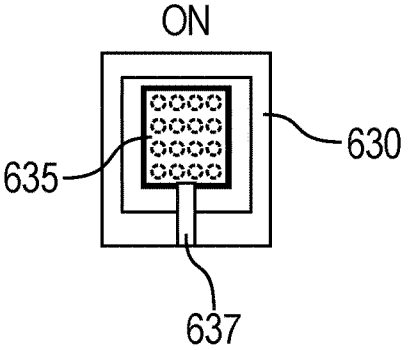
FIG. 8A is a cross-sectional view of the analysis module of FIG. 7A. Here, the cutting filter screen is visible in its "On" position.

FIG. 8A is a cross-sectional view of the analysis module 620 of FIG. 7A.

Here, the cutting filter screen 635 is again raised to its "On" position. A stem 637 is shown that rotates the cutting filter screen 635 up into the flow path of the drill cuttings 400.

Figure 8B:
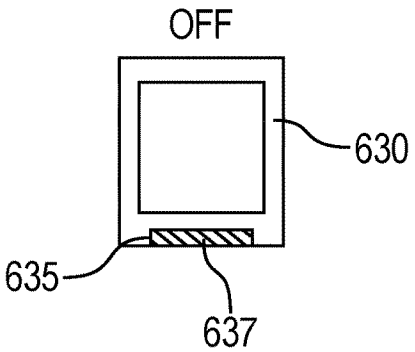
FIG. 8B is another cross-sectional view of the cutting filter screen of FIG. 7B. Here, the cutting filter screen is in its "Off" position.

FIG. 8B is an end view of the analysis module 620 of FIG. 7B. Here, the cutting filter screen 635 has moved to its "Off" position. The stem 637 has rotated the cutting filter screen 635 down and out of the flow path of the drill cuttings 400.

It is understood that other mechanisms (or "internals") may be used as the cutting filter screen 635. For example, a grate or ladder or other internals may be used along the flow path of the cuttings 400 within the analysis module 620 to impede flow "W."

The gate 635 will cyclically turn to its On position to filter the solid cuttings 400 from the flow "W" to enable the sensors 322, 324, 326, 328 to take more accurate readings. After the readings are taken, the gate 635, will automatically turn Off, rotating down to the base and allowing the measured drill cuttings 400 to exit to the analysis module 210.

Returning to FIGS. 6, 7A and 7B, it can be seen that the tubular body 630 of the analysis module 620 has a four-sided profile. Four side grooves 632 are placed along the sides. Three of the grooves 632 are used to install sensors such as the sonic sensor 322, the gamma ray sensor 324, the resistivity sensor 326, or the density log sensor 328. The fourth groove 632 is used to install the processor 350 (with motherboard), a power supply (such as battery 260), and any ancillary hardware used for the analysis module 620. Camera 660 optionally resides within the container 630 and provides digital images to the processor 350 as described above for camera 560.

The processor 350 for both analysis module 220 and 620 operates with user software that enables the processor 350 to process, analyze and store data. Every drilled cutting from the bit 172 traveling up to the surface 101 can be traced to the depth it was originally drilled from, such as by using the "cutting lag time" calculation. This technique is used to correlate the sensor readings to the cutting samples' original depth.

Figure 9:
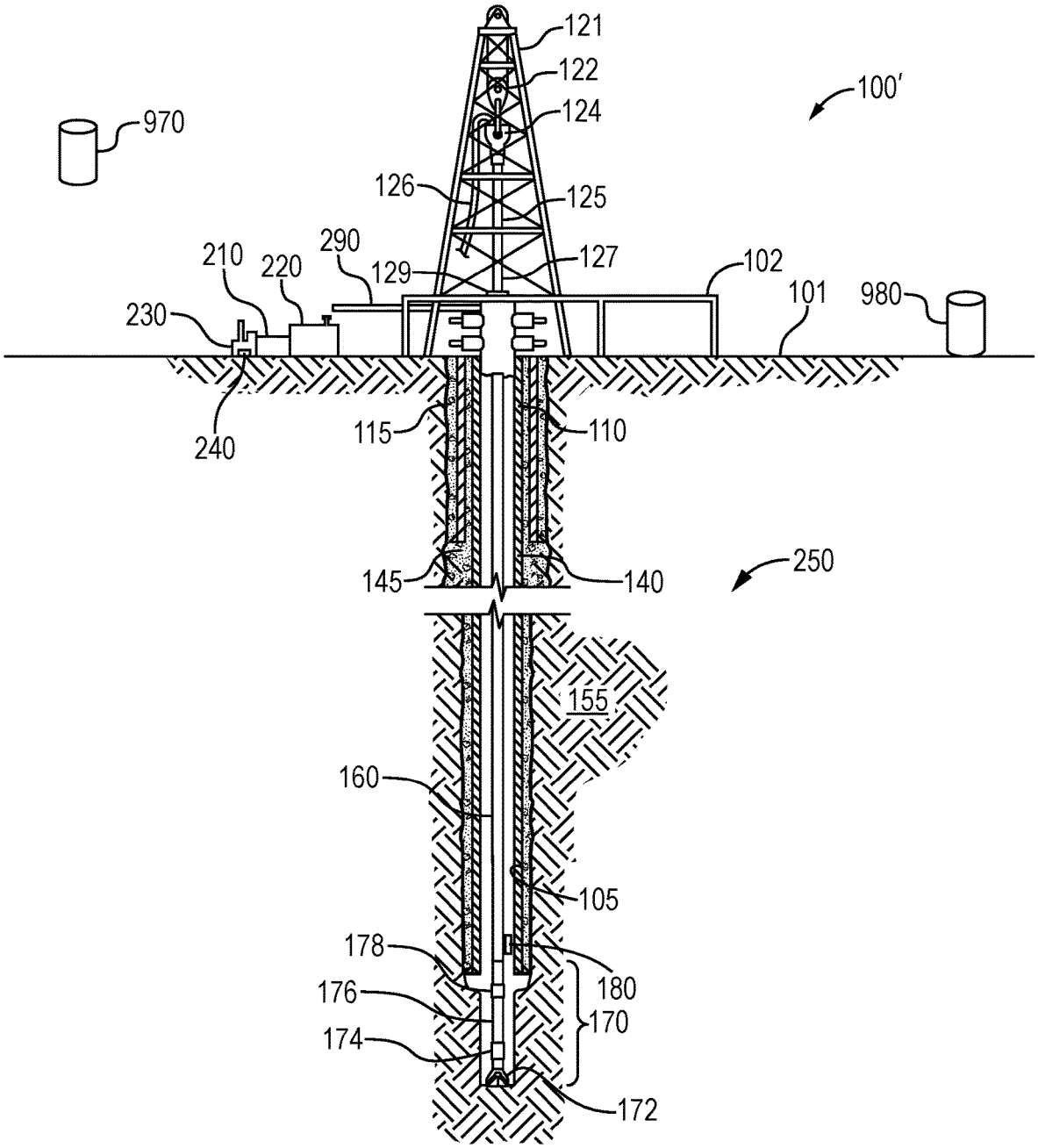
FIG. 9 is another view of the wellbore of FIG. 2 being formed through a drilling process. In this embodiment, various sensors are placed along the drill pipe, with signals being sent back up to the pipe connector at the surface.

FIG. 9 is another view of the wellbore 250 of FIG. 2 being formed through a drilling process. In this embodiment, a downhole sensor 180 is placed in close proximity to the drill bit 172 or other otherwise along the bottom hole assembly 170. The sensor 180 is a downhole log that measures one or more characteristics of the formation as cuttings are being formed by the drill bit 172 during drilling. This may be part of a Logging While Drilling package. Signals indicative of measurements taken by the sensor 180 are sent from the wellbore 150 up to the analysis module 620 at the surface 101. Specifically, signals concerning resistivity, radioactivity or other characteristic are sent to a processor at the surface, such as processor 350.

As an aside, shale can be identified from the rest of the cuttings from its high gamma ray readings. This is due to the presence of radioactive material. The radioactive material can be detected using any gamma ray sensor to differentiate between shale and non-shale.

As spectral gamma ray sensors are used here, the specific type of shale clay can be identified. Knowing so allows the drillers and mud engineers to treat the shale being drilled with the right mud additives to reduce shale swelling.

As the drill bit 172 drills new rock, it is important to remove all drilled cuttings up to the surface 101. However, there is always a chance that drill cuttings may accumulate along portions of the borehole wall 185 or casing 110, as the case may be. When the drill cuttings include shale, it is important to keep the shale moving to the surface expeditiously as shale tends to be a sticky, muddy material. If shale isn't transported out of the hole 150 while drilling, the drill pipe 160 can get stuck.

Readings taken by the MWD or LWD equipment downhole will be transmitted to the surface. This may be done, for example, by using communications nodes such as those taught in U.S. Pat. No. 10,167,717. That patent is entitled "Telemetry For Wireless Electro-Acoustical Transmission of Data Along a Wellbore." Alternatively, communication may be done using the wired and wireless telemetry system taught in U.S. Pat. No. 10,100,635. That patent is entitled "Wired and Wireless Downhole Telemetry Using a Logging Tool." Each of these patents is incorporated herein by reference.

In a more preferred method, data is sent up the wellbore using a mud pulser unit. Mud pulser units vary the drilling fluid pressure inside the drill string. The pressure fluctuations are decoded and displayed on surface system computers as outputs from the sensors. The mud pulser units may be combined with known logging while drilling systems.

The processor may compare the log results of sensor(s) 180 taken in the bottom hole assembly 170 with log readings taken by the one or more sensors in the analysis module. If the characteristics of the cuttings correlated with depth are the same, this indicates good hole cleaning, confirming that expected amounts of drill cuttings are being circulated up the wellbore and to the surface.

Beneficially, the shale shaker systems 200, 600 herein may augment LWD or MWD measurements by providing a redundant source of information should the LWD/MWD measurement devices fail. For example, if a downhole logging sensor 180 fails to read the bottom hole rock data, the sensors 322, 324, 326, 328 inside the analysis module 220 or 620 will give the reading once the cuttings 400 are at the surface 101. It will be appreciated that the temperature and pressure of the cuttings 400 at the surface 101 will be lower than in the wellbore 250, allowing for more accurate measurements to be taken.

In the present application, a sensor in the analysis module 220 or 620 may also be used to estimate the shale volume reaching the surface 101. This can be compared to the estimated shale volume using the LWD gamma ray readings 170. When the volume of the shale exiting the borehole at the surface 101 is less than the volume that was drilled at depth, then the software raises an alert of a potential pipe jam as this is an indication that the wellbore is not cleaned properly and there is a risk of pipes getting stuck. A signal may optionally be sent to the driller alerting as to this condition of poor cuttings circulation. The driller may then partially pull out of the hole and ream the borehole using the drill bit, thus avoiding a stuck pipe incidence.

Figure 10:
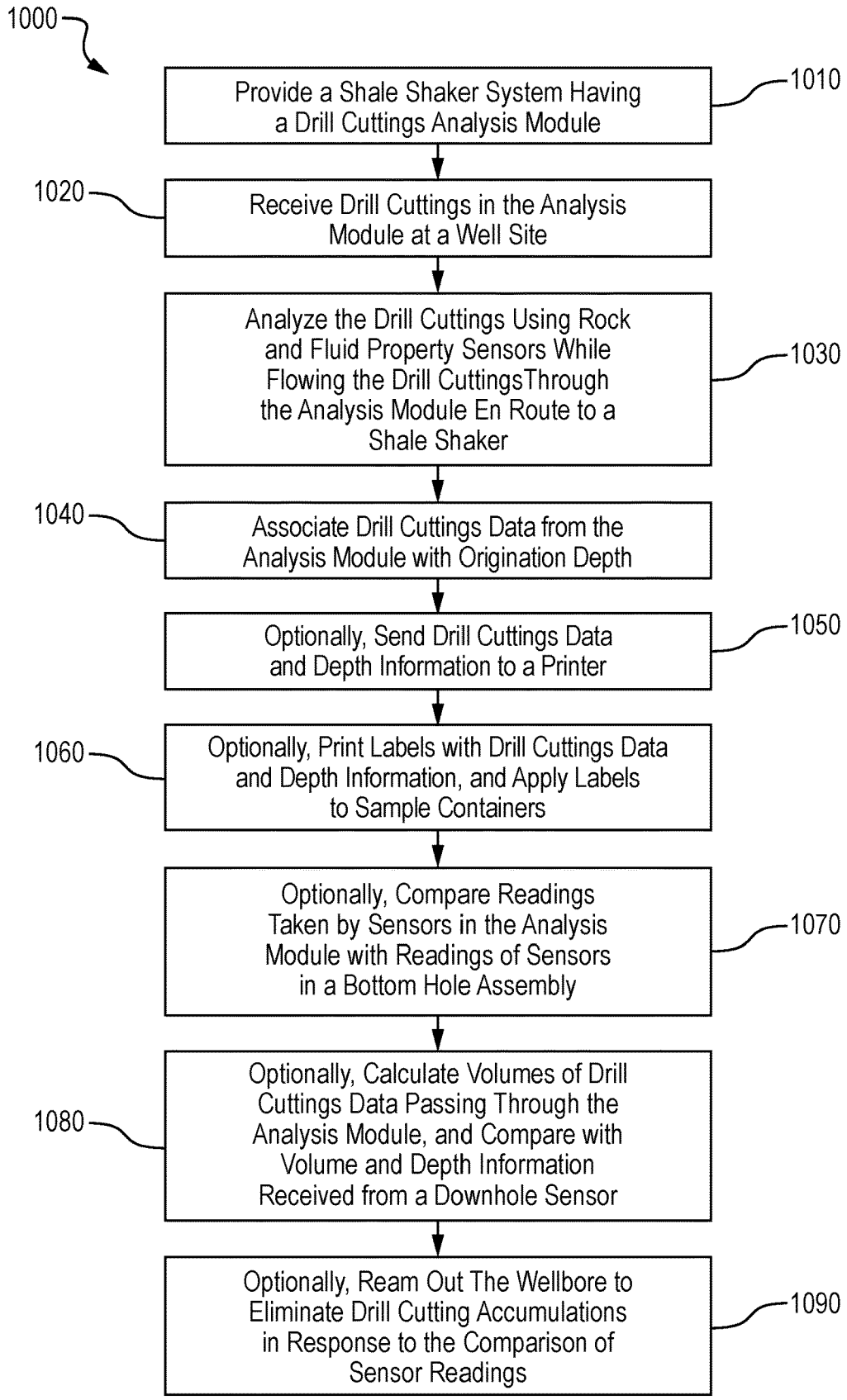
FIG. 10 is a flow chart showing steps for analyzing drill cuttings at a drill site, in various embodiments.

Based on the features presented in FIGS. 2 through 9, unique methods for analyzing and using data obtained from dill cuttings are presented. FIG. 10 presents a flow chart showing operational steps for a method 1000 of analyzing drill cuttings at a drill site, in various embodiments.

The method 1000 first includes providing a shale shaker system. This is shown at Box 1010. In the step of Box 1010, the shale shaker system includes an analysis module used for analyzing drill cuttings in real time. The analysis module may be in accordance with the modules 220 or 620 described above, or their substantial equivalents. Specifically, the analysis module will comprise two or more sensors representing (i) a sonic log sensor, (ii) a gamma ray log sensor, (iii) a resistivity log sensor, (iv) a density log sensor, or (v) combinations thereof.

The method 1000 next comprises receiving drill cuttings in the analysis module. This is provided in Box 1020. The drill cuttings are received at a well site, at the surface. The drill cuttings are part of a drilling fluids return stream generated during a wellbore drilling operation.

The method 1000 also includes analyzing the drill cuttings. This is seen at Box 1030. The drill cuttings are analyzed using sensors residing within or along the analysis module. The sensors measure rock and/or fluid properties as the drill cuttings flow through the analysis module en route to a shale shaker. The sensors send signals to a processor which generates Drill Cuttings Data in real time. The Drill Cuttings Data may include rock properties indicative of lithology, and fluid properties indicative of the presence of water vs. hydrocarbons.

Preferably, the analysis module includes a sampling chamber, wherein the sampling chamber includes a camera. The camera takes digital images of the drill cuttings as they fall into or otherwise move through the sampling chamber. The sampling chamber may include appropriate lights to illuminate the sampling chamber as the cuttings are photographed. Preferably, the cuttings land onto a sieve table where they are washed prior to being photographed. The camera is configured to send digital files to a processor, wherein operational software identifies the lithology of the drill cuttings based on size, shape, color, or combinations thereof. This will be part of the Drill Cuttings Data.

The method 1000 additionally comprises associating the Drill Cuttings Data from the analysis module with origination depth. This is provided in box 1040. Origination depth refers to the depth in the wellbore at which the drill cuttings were removed. This may involve a so-called lag-time calculation by the processor or by separate drilling software which communicates with the processor. Preferably, software operating with the rig will separately calculate lag time and send data to the processor as Depth Information. In this respect, the drilling rig will know at what depth the cuttings coming to the surface were drilled. The processor will then associate the Depth Information with the Drill Cuttings Data.

The method 1000 further includes optionally sending Drill Cuttings Data and Depth Information to a printer. This is shown at Box 1050. The printer is preferably on-site, and is used by the driller or shale shaker operator to generate labels for drill cutting sample containers.

The method 1000 further comprises printing the labels with the Drill Cuttings Data and the Depth Information, and applying those labels to the drill cutting sample containers. This is offered at Box 1060 of FIG. 10. Preferably, the drill cutting sample containers are automatically loaded in accordance with the collection device shown and described in connection with FIG. 5.

The method 1000 may additionally provide a step of comparing the log results of sensors taken in the analysis module with log readings taken by one or more sensors in a bottom hole assembly. This is seen at Box 1170. The processor will compare the readings of the cuttings while they were downhole using the LWD tools (as Wellbore Data) with the readings of those same cuttings when they are at surface using the surface sensors (the Drill Cuttings Data). If the characteristics of the cuttings correlated with depth are the same, this indicates good hole cleaning. This allows the processor to determine if expected amounts of drill cuttings are being circulated up the wellbore and to the surface.

The method 1000 may also include the step of calculating volumes of drill cuttings passing through the analysis module. This is indicated at Box 1080. The volume of shale can be calculated using the gamma ray sensor 324. In connection with the step of Box 1080, the processor will compare the estimated volume of shale passing through the analysis module 220 or 620 with the estimated volume of shale gleaned from downhole logging or sensing tools. The processor will also correlate such volume information with the calculated Depth Information. If the processor detects a lower volume of estimated shale at surface than the estimated volume of shale downhole, then the driller or operator will be notified that the drill cuttings may be accumulating along borehole. Stated another way, if the downhole sensor is reading more shale volume than are transported to surface for a certain time, then cuttings are not being adequately circulated or "cleaned" from the hole.

Finally, the method 1000 may include the step of reaming out the wellbore. This is shown in Box 1090. The purpose of the step of Box 1090 is to eliminate accumulations of drill cuttings and mud along the borehole or casing walls.

Based on the descriptions and drawings provided above, a separate method of sampling drill cuttings from a wellbore is also provided. A result of the sampling process is that Drill Cuttings Data is generated in real time.

The method first comprises receiving drill cuttings into an analysis module. The analysis module is in accordance with the analysis modules 220 or 620 described above. The analysis module is located at a well drilling site. Preferably, the analysis module resides at the surface near a shale shaker.

The method also includes passing at least selected portions of the drill cuttings across one or more sensors. The sensors may be any of the sensors 322, 324, 326, 328 described above, or other logging tool.

The method additionally comprises dropping the selected portions of the drill cuttings onto a platform. The method then includes photographing the selected portions of the drill cuttings at selected time intervals. Photographic samples may be taken as the cuttings are gravitationally moving onto the platform, or after they have been placed onto the platform.

The method also includes transmitting log signals from the one or more sensors to a processor. The log signals are processed to generate Drill Cuttings Data. At the same time, the method includes transmitting image signals from the camera to the processor. The processor processes the image signals and converts them into Lithology Data. Stated another way, images taken by the camera are analyzed and then correlated to rock type. The processor is configured to correlate the Drill Cuttings Data and Lithology Data to wellbore depth, or Depth Information.

The systems and methods disclosed above allow for a continuous monitoring of the volume and type of material exiting the bore hole. In addition, the sampling of material is automated from the shaker, thus reducing or eliminating the need for skilled labor and the associated cost thereof. In one aspect, the analysis module is located on or immediately adjacent to the rig floor, and in close proximity to the flow of drilling fluid returns out of the well being drilled.

The particular embodiments disclosed above are illustrative only, as the embodiments may be modified and practiced in different but equivalent manners apparent to those skilled in the art having the benefit of the teachings herein. Although the present embodiments are shown above, they are not limited to just these embodiments, but are amenable to various changes and modifications without departing from the spirit thereof.

The following advantages may be obtained from certain aspects of the embodiments disclosed above:

Drilling companies can use the analysis modules to obtain data from sensors residing at the surface instead of running expensive LWD tools. This can be seen in development wells in fields which have more than one offset, and so this invention satisfies their logging demands. Moreover, the analysis modules, and particularly module 620, may be incorporated into existing shale shaker systems.

Alternatively, the analysis modules may augment the downhole LWD GR in case of LWD failure. The surface sensors can be calibrated so that when something goes wrong with the LWD, there will be no need to pull the LWD out of hole. Of note, a calibrated log is still obtained.

The first LWD sensor offset/distance is normally around 10 meters from the bit; making it difficult if not impossible to read data on the deeper rock formation where the casing shoe is afterwards set. However, the shale shaker sensors can log and analyze the rocks under the LWD sensors when the rocks arrive at the surface.

The analysis modules may be used with equal success when drilling High Temperature/High Pressure wells. As LWD tools most times fail inside the hole at such conditions and their log readings are mostly affected with such environments. On the other hand, the sensors on the surface can be used to provide all the necessary logs as soon as the cuttings come to surface conditions.

The analysis modules allow for the use of spectral gamma ray sensors which help in identifying shale type (or shale lithology). This enables the driller to select mud additives or chemicals designed to reduce the risk of shale swelling or bit balling in the particular wellbore. A tank for mixing mud additives is shown in FIG. 9 at 970, while a separate tank for storing wellbore treatment chemicals is shown at 980.

The analysis modules allow a 360° average measurement log of the hole cuttings as the cuttings are received from a drilled hole. This is in contrast to LWD sensors that are only directed to one side of the wellbore. The analysis modules thus generate a more accurate picture of lithology and wellbore properties rather than being biased towards a certain direction and angle. Moreover, in one aspect the lithology analysis may be conducted in real time using specialized digital image processing software that identifies certain shapes and sizes of cuttings. Optionally, alerts may be integrated into the software, sending signals to the geologist or other professional when certain types of cuttings are identified.

The analysis modules can be used together with the LWD sensors to estimate the lag depth and time of the cuttings. This may be done by calibrating the time for a certain formation of known properties to come from bottom to surface.

As an additional feature of the present disclosure, the operator may gather or otherwise have access to wellbore data from offset wells. These are wells that have been drilled in the same field. The wellbore data may include core analysis as made by a geologist or other downhole service provider. Such core analysis may be in the form of logs. Alternatively or in addition, the offset wellbore data may include data derived from cuttings generated by the drilling process for the offset wells. Such cuttings data is sometimes referred to as "surface logs." Alternatively or in addition, the offset wellbore data may include data derived from Logging While Drilling logs.

In any instance, the operator may analyze the wellbore data from the offset wells. This may be done manually, or more preferably may be done by inputting the data into a geology module referred to as Offset Drill Cuttings Data. The geology module is a library of subsurface data stored in memory and available for reference during the drilling of the current well.

In another aspect, an algorithm is provided as part of the Offset Drill Cuttings Data. The algorithm creates a synthetic LWD log. Machine learning techniques may be applied to correlate all of the offset wellbore data (e.g., core samples, surface logs and LWD logs). The algorithm can then be applied to Well Cuttings Data generated by the newly drilled well to create synthetic LWD logs from the arriving cuttings.

Based on this additional disclosure, a separate method of analyzing drilling fluid returns is provided. In one aspect, the method first comprises receiving wellbore data from drilling operations conducted for offset wells. The offset wells, of course, are located in the same production field. The wellbore data comprises (i) logs generated from core samples, (ii) logs generated from drill cuttings analysis at a surface, (iii) logs generated by downhole Logging While Drilling systems, or (iv) combinations thereof.

The method also includes combining the wellbore data from the offset wells in the field to create Offset Drill Cuttings Data. The Offset Drill Cuttings Data is stored in memory, providing a library of geological data.

The method additionally comprises providing a shale shaker system. The shale shaker system may be in accordance with any of the embodiments described above, including without limitation the analysis module and system of FIG. 7A. Of interest, the analysis module will have at least two sensors residing within the container 630. Those sensors may comprise (i) a sonic log sensor, (ii) a gamma ray log sensor, (iii) a resistivity log sensor, (iv) a density log sensor, or (v) combinations thereof.

The method will further include comparing the Offset Drill Cuttings Data with the Drill Cuttings Data from the new well site. This comparison may be done by the driller manually. More preferably, the comparison is done digitally by an analysis module. During the drilling process, the Drill Cuttings Data generated by the processor 350 for the analysis module (e.g., module 620) is compared with the library of subsurface data stored in the Offset Drill Cuttings Data, i.e., the geology module. The Drill Cuttings Data may recognize comparable geological layers, or formations, previously identified in the Offset Drill Cuttings Data. In one aspect, an alert may be sent to the driller if it is known that a comparable geological layer represents a high-pressure formation. In this way, measures may be taken to prevent a kick in pressure, e.g., adding density to the drilling mud.

In another aspect, correlating the Offset Drill Cuttings Data with the real time Drill Cuttings Data of the new well may inform the driller about other drilling parameters. These may include optimum rate of penetration, best practices for composition of the drilling fluid, ideal drill bit configurations, and so forth.

The particular embodiments and advantages disclosed above may be altered or modified in ways that would be obvious to a person of ordinary skill in the art based upon review of the disclosure herein, and all such variations are considered within the scope and spirit of the application.

I claim:

1. An analysis module for a shale shaker system, comprising:

a container configured to receive a stream of fluid returns comprising drill cuttings at a well site, the container having an inlet and an outlet, and defining a tank having a wall forming an internal volume;

one or more sensors residing within the internal volume of the container comprising (i) a sonic log sensor, (ii) a gamma ray log sensor, (iii) a resistivity log sensor, (iv) a density log sensor, or (v) combinations thereof;

a processor configured to receive electrical signals from the one or more sensors, with the processor having operating software to determine characteristics of the fluid returns and drill cuttings passing through the container in real time, as Drill Cuttings Data;

wherein:

the processor receives or, alternatively, calculates information indicative of a depth of the drill cuttings passing through the container as Depth Information, and associates the Depth Information with the Drill Cuttings Data;

the container resides downstream from a fluid transport pipe, with the fluid transport pipe being configured to receive the stream of fluid returns from a wellbore at the well-site during a drilling operation and deliver them to the inlet of the container;

a majority of the drill cuttings move through the tank and gravitationally travel towards the outlet of the container to the shale shaker screens; and the container resides upstream from one or more shale shaker screens associated with the shale shaker system for filtering the drill cuttings from the fluid returns.

2. The analysis module of claim 1, wherein:

the one or more sensors comprises at least two sensors;

the inlet is proximate an upper end of the container, and the outlet is proximate a lower end of the container such that the outlet gravitationally receives the drill cuttings and fluid returns.

3. The analysis module of claim 1, wherein the analysis module is configured to receive signals from a gamma ray sensor residing downhole during the wellbore drilling operation, such signals being indicative of bulk density of the drill cuttings within the fluid returns moving up the wellbore, and compare the signals indicative of bulk density in the wellbore with gamma ray signals from drill cuttings in the container at a correlated depth, and thereby determine whether drill cuttings are being returned to the surface.

4. The analysis module of claim 1, wherein the shale shaker screens are configured to receive vibrational energy from a motor during filtering.

5. The analysis module of claim 1, wherein:

the one or more sensors are arrayed along a wall of the tank.

6. The analysis module of claim 5, wherein the processor is further configured to:

receive log data from a bottom hole assembly associated with a wellbore at the well site as Wellbore Data; and compare the Wellbore Data with Drill cuttings Data at corresponding depths to confirm that drill cuttings are being circulated to a surface of the well site.

7. The analysis module of claim 1, wherein:

the one or more sensors comprises at least two sensors;

the container comprises an intermediate chute configured to gravitationally release samplings of the drill cuttings into a sampling chamber below the container.

8. The analysis module of claim 7, wherein the sampling chamber comprises a conveyor system configured to present containers below the chute to receive drill cuttings and to transport them out of the sampling chamber.

9. The analysis module of claim 7, wherein:

the chute comprises a door configured to be periodically opened, thereby releasing drill cuttings from the analysis module at selected intervals of time; and the sampling chamber comprises a camera configured to photograph drill cuttings at selected intervals of time as the drilling cuttings are gravitationally released from the chute and through the door, and to generate digital files indicative of photographs taken by the camera.

10. The analysis module of claim 9, further comprising a processor configured to receive the digital files and to process the digital files and identify a lithology of the drill cuttings as Lithology Data, and associate the Lithology Data with the Depth Information.

11. The analysis module of claim 9, wherein the sampling chamber further comprises:

a sieve table configured to gravitationally receive the drill cuttings from the chute;

at least one light configured to illuminate the drill cuttings as they fall from the chute; and a washing system configured to rinse the drill cuttings as they land onto the sieve table.

* * * * *